US010115383B2

(12) United States Patent
Shaw et al.

(10) Patent No.: US 10,115,383 B2
(45) Date of Patent: Oct. 30, 2018

(54) HUMBUCKING PICKUP AND METHOD OF PROVIDING PERMANENT MAGNET EXTENDING THROUGH OPPOSING COILS PARALLEL TO STRING ORIENTATION

(71) Applicants: Fender Musical Instruments Corporation, Scottsdale, AZ (US); E.L.V.H., Inc., Los Angeles, CA (US)

(72) Inventors: Timothy P. Shaw, Hendersonville, TN (US); Edward Lodewijk Van Halen, Los Angeles, CA (US); Matthew Jonathon Bruck, Studio City, CA (US); Joshua D. Hurst, Nashville, TN (US)

(73) Assignees: Fender Musical Instruments Corporation, Scottsdale, AZ (US); E.L.V.H., Inc., Los Angeles, CA (US)

( * ) Notice: Subject to any disclaimer, the term of this patent is extended or adjusted under 35 U.S.C. 154(b) by 0 days.

(21) Appl. No.: 15/292,050

(22) Filed: Oct. 12, 2016

(65) Prior Publication Data

US 2018/0102121 A1 Apr. 12, 2018

(51) Int. Cl.
*G10H 3/18* (2006.01)
*G10H 3/14* (2006.01)

(52) U.S. Cl.
CPC ..... *G10H 3/181* (2013.01); *G10H 3/182* (2013.01); *G10H 2220/515* (2013.01)

(58) Field of Classification Search
CPC ... G10H 3/181; G10H 3/182; G10H 2220/515
(Continued)

(56) References Cited

U.S. PATENT DOCUMENTS 2,119,584 A 6/1938 Knoblaugh
2,896,491 A 7/1959 Lover
(Continued)

FOREIGN PATENT DOCUMENTS

CA 2869073 A1 4/2016

OTHER PUBLICATIONS

Amazon, BQLZ Silver Smooth pickup, first available on Feb. 26, 2016, [online], [site visited on Jan. 19, 2018]. Available from Internet,<URL:https://www.amazon.co.uk!BQLZR-Silver -Smooth-Alum in u m-Eiectric/dp/BO1C8FPA68/ref=sr 1_3?ie=UTF8&qid=1516388721&sr=8-3&keywords=pickup+with+no+holes> (Year: 2016).
(Continued)

*Primary Examiner* — Elvin G Enad
*Assistant Examiner* — Christina Schreiber
(74) *Attorney, Agent, or Firm* — Robert D. Atkins; Patent Law Group: Atkins and Associates, P.C.

(57) ABSTRACT

A humbucking pickup for a musical instrument has a bobbin assembly with first and second bobbins. The musical instrument can be an electric guitar. A first coil is wound around the first bobbin, and a second coil is wound around the second bobbin. A permanent magnet or a plurality of permanent magnets extend through the first coil and second coil of the bobbin assembly. A housing is disposed over the bobbin assembly. Blades are disposed over side surfaces of the housing to redirect the magnetic flux toward the strings. A plurality of strings of the musical instrument is routed over a top surface of the housing parallel to opposing poles of the permanent magnet. Movement of the strings of the musical instrument disturbs a magnetic flux of the permanent magnet proximate to a first pole of the permanent magnet and a second pole of the permanent magnet.

25 Claims, 21 Drawing Sheets

(58) Field of Classification Search
USPC ..... 84/728, 726
See application file for complete search history.

(56) References Cited

U.S. PATENT DOCUMENTS 2,911,871 A 11/1959 Schultz
3,236,930 A 2/1966 Fender
3,657,461 A * 4/1972 Freeman ..... G10H 3/181 84/726
3,902,394 A 9/1975 Stich
3,916,751 A 11/1975 Stich
4,026,178 A * 5/1977 Fuller ..... G10H 3/183 84/726
4,069,732 A 1/1978 Moskowitz et al.
4,133,243 A 1/1979 DiMarzio
4,184,398 A 1/1980 Siegelman
4,220,069 A * 9/1980 Fender ..... G10H 3/182 84/726
4,379,421 A 4/1983 Nunan
4,442,749 A * 4/1984 DiMarzio ..... G10H 3/181 84/728
4,450,748 A * 5/1984 Shaw ..... G10D 1/085 84/291
4,524,667 A * 6/1985 Duncan ..... G10H 3/181 84/728
4,657,114 A * 4/1987 Shaw ..... G10H 3/185 84/731
4,809,578 A * 3/1989 Lace, Jr. ..... G10H 3/181 84/726
4,854,210 A * 8/1989 Palazzolo ..... G10H 3/181 84/726
D323,669 S 2/1992 Pagelli
5,148,733 A 9/1992 Beller
5,168,117 A 12/1992 Anderson
5,200,569 A 4/1993 Moore
5,288,119 A 2/1994 Crawford, Jr. et al.
5,290,968 A * 3/1994 Mirigliano ..... G10H 3/181 84/726
5,292,998 A * 3/1994 Knapp ..... G10H 3/181 84/726
5,336,845 A * 8/1994 Lace, Sr. ..... G10H 3/181 84/726
5,378,850 A * 1/1995 Tumura ..... G10H 3/26 84/727
D355,207 S 2/1995 Beller
5,389,731 A * 2/1995 Lace ..... G10H 3/181 84/726
5,391,831 A 2/1995 Lace
5,391,832 A 2/1995 Lace
5,408,043 A * 4/1995 Lace ..... G10H 3/181 84/726
5,422,432 A * 6/1995 Lace ..... G10H 3/181 84/726
5,455,381 A * 10/1995 Juszkiewicz ..... G10D 3/04 84/727
5,464,948 A * 11/1995 Lace ..... G10H 3/181 84/726
5,508,474 A * 4/1996 Tumura ..... G10H 3/181 84/726
5,525,750 A * 6/1996 Beller ..... G10H 3/182 84/726
5,530,199 A * 6/1996 Blucher ..... G10H 3/181 84/728
5,610,357 A * 3/1997 Frank-Braun ..... G10H 3/181 84/726
5,789,691 A 8/1998 Stich
5,811,710 A * 9/1998 Blucher ..... G10H 3/181 84/728
5,834,999 A 11/1998 Kinman
5,908,998 A * 6/1999 Blucher ..... G10H 3/181 84/723
6,103,966 A 8/2000 Kinman
6,111,185 A * 8/2000 Lace ..... G10H 3/181 84/726
6,271,456 B1 8/2001 Nelson
6,291,759 B1 * 9/2001 Turner ..... G10H 3/181 336/110
7,022,909 B2 * 4/2006 Kinman ..... G10H 3/181 84/726
D520,048 S 5/2006 Krozack et al.
7,166,793 B2 1/2007 Beller
7,227,076 B2 * 6/2007 Stich ..... G10H 3/181 84/726
7,285,714 B2 * 10/2007 Juszkiewicz ..... G10H 3/181 84/298
7,427,710 B2 * 9/2008 Hara ..... G10H 3/182 84/723
7,718,886 B1 * 5/2010 Lace ..... G10H 3/181 84/727
7,994,413 B2 * 8/2011 Salo ..... G10H 3/181 84/726
8,969,701 B1 * 3/2015 Dixon ..... G10H 3/143 84/723
9,601,100 B1 * 3/2017 Dixon ..... G10H 3/181
2002/0020281 A1 * 2/2002 Devers ..... G10H 3/181 84/728
2002/0083819 A1 * 7/2002 Kinman ..... G10H 3/181 84/726
2002/0092413 A1 * 7/2002 Turner ..... G10H 3/181 84/726
2005/0109197 A1 * 5/2005 Garrett ..... G10H 3/182 84/726
2005/0162247 A1 7/2005 Beller
2006/0156911 A1 * 7/2006 Stich ..... G10H 3/181 84/726
2007/0017355 A1 * 1/2007 Lace ..... G10H 3/181 84/728
2010/0122623 A1 * 5/2010 Salo ..... G10H 3/181 84/726
2012/0103170 A1 * 5/2012 Kinman ..... G10H 3/181 84/726
2013/0019736 A1 1/2013 Finkle
2013/0312591 A1 * 11/2013 Mills ..... G10H 3/181 84/726
2013/0327202 A1 * 12/2013 Mills ..... G10H 3/181 84/726
2014/0202319 A1 * 7/2014 Osborne ..... G10H 3/181 84/728
2014/0245877 A1 * 9/2014 Gelvin ..... G10H 3/181 84/727
2014/0373701 A1 * 12/2014 Yaron ..... G10H 3/143 84/726
2015/0262568 A1 * 9/2015 Krasnov ..... G10H 3/143 84/728
2015/0317966 A1 * 11/2015 Liptac ..... G10H 1/32 84/735
2015/0379978 A1 * 12/2015 Jang ..... G10H 3/181 84/726
2016/0314775 A1 * 10/2016 Wolf ..... G10H 3/183
2018/0102121 A1 * 4/2018 Shaw ..... G10H 3/181
2018/0122350 A1 * 5/2018 Krasnov ..... G10H 3/181

OTHER PUBLICATIONS

Guitar Center, DiMarzio DP218 Super Distortion Strat Hum bucker Pickup, customer review May 9, 2016, [online], [site visited on Jan. 19, 2018]. Available from Internet, <URL: http://www.guitarcenter.com/DiMarzio/DP218-Super-Distortion-S-Strat-Humbucker-Pickup-White-1296839766977.gc> (Year: 2016).

Guitar Center, Seymour Duncan STR-1 Vintage '54 Electric Guitar Pickup, customer review Nov. 9, 2010, [online], [site visited on Jan. 19, 2018]. Available from Internet, <URL: http://www.guitarcenter.com/Seymour-Duncan/STR-1-Vintage-54-Tele-Rhythm-Eiectric-Guitar-Pickup.gc> (Year: 2010).

Guitar Center, Lace Sensor Gold Guitar Pickups, customer review Jan. 19, 2007, [online], [site visited on Jan. 26, 2018]. Available from Internet, <URL:http://www.guitarcenter.com/Lace/Sensor-Gold-Guitar-Pickups-3-Pack-S-S-S-Set.gc> (Year: 2007).

(56) References Cited

OTHER PUBLICATIONS

Mike & Mike's Guitar Bar, Demystifying the Fender Jazzmaster and Jaguar pt. 4: Pickup Lines, posted Jul. 23, 2013, [online], [site visited Jan. 26, 2018]. Available from Internet, <URL:https://mmguitarbar.com/2013/07/23/demystifying-the-fender-jazzmaster-and-jaguar-pt-4-pickup-lines/> (Year: 2013).

* cited by examiner

HUMBUCKING PICKUP AND METHOD OF PROVIDING PERMANENT MAGNET EXTENDING THROUGH OPPOSING COILS PARALLEL TO STRING ORIENTATION

FIELD OF THE INVENTION

The present invention relates in general to musical instruments and, more particularly, to a humbucking pickup with a permanent magnet extending through opposing coils in parallel to string orientation to convert movement of the strings into corresponding electrical signals representative of the sounds depicted by the strings, while providing cancellation of external interference.

BACKGROUND OF THE INVENTION

Many musical instruments include strings which the player imparts movement to generate sound. In the case of an electric guitar, the audio sound is produced indirectly from the motion of the string, typically steel strings, over a magnetic pickup. The magnetic pickup includes a bobbin wrapped with a coil of fine enameled copper wire and a permanent magnet with a core material, such as alnico or ferrite. The pickup is most often mounted on the body of the guitar. The permanent magnet creates a magnetic field, and the strings are routed through the magnetic field. When the electric guitar is played, the motion of the vibrating steel strings disturbs the magnetic field and changes the magnetic flux to induce a voltage in the coil. The changes in voltage from the vibrating strings produce a current in the coil representative of the string motion and, correspondingly, the sound intended by the player. Accordingly, the pickup operates as a transducer or variable reluctance sensor that converts mechanical string vibrations to an electrical signal, which is routed to an amplifier and loudspeaker to reproduce an audible sound.

In a traditional single coil magnetic pickup, the turns of wire in proximity to each other have an equivalent self-capacitance that, when added to cable capacitance, resonates with the inductance of the winding. The resonance accentuates certain frequencies, giving the pickup a characteristic tonal quality. More turns of wire in the winding produces a higher output voltage and lower resonance frequency. The inductive source impedance inherent in a single coil pickup makes it less linear than other forms of pickups, such as piezo-electric or optical transducers. The tonal quality produced by such nonlinearity is, however, subject to taste, and some artists consider the sound aesthetically superior to a more linear transducer.

The single coil pickup is susceptibility to external electromagnetic interference (mains hum), e.g., from electrical power cables, power transformers, and fluorescent light ballasts in the area, as well as the magnetic interference with the natural vibrations of the strings. Mains hum typically includes a fundamental frequency at 50-60 Hz and some harmonic content. The changing magnetic flux caused by the mains current links with the windings and induces an undesired voltage variation in the pickup.

FIG. 1 shows a typical humbucking pickup 10 for overcoming the mains hum effect by using two coils 12 and 14, with each coil wound or connected in opposition to the other around bobbin 16. A plurality of cylindrical permanent magnets 20 are disposed through bobbin 16 in an interior area of coil 12 in humbucking pickup 10, and a plurality of cylindrical permanent magnets 22 is disposed through bobbin 16 in an interior area of coil 14. Magnets 20 are aligned with magnets 22 in the respective windings. Since ambient hum from power-supply transformers, radio frequencies, or electrical devices reaches the coils as common-mode noise, the external interference induces an equal and opposite voltage in each coil, which tends to cancel each other out due to the opposition of coils 12 and 14.

In particular, humbucking pickup 10 is mounted to electric guitar body 30 with cylindrical magnets 20 and 22 oriented perpendicular to guitar strings 32, as shown in FIG. 1. Magnet flux lines emanating from the north pole N of permanent magnet 20 are perpendicular or normal to the longitudinal axis of strings 32. Strings 32 vibrate through the magnetic field across the north pole N of cylindrical magnets 20, which changes the magnetic flux and induces a voltage in coils 12 and 14. The changes in voltage from the vibrating string 32 produces a current in coils 12 and 14 representative of the string motion and, correspondingly, the sound intended by the player. The electrical signal is routed to an amplifier and loudspeaker to reproduce an audible sound.

Coils 12 and 14 are wound or connected in opposition so that external interference, e.g., ambient hum from power-supply transformers, radio frequencies, or electrical devices, induces an equal and opposite voltage in each coil which tends to cancel out external interference. Humbucking pickup 10 with permanent magnets 20 and 22 oriented perpendicular to guitar strings 32 achieves a level interference cancellation, albeit with the associated higher cost and larger form factor.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
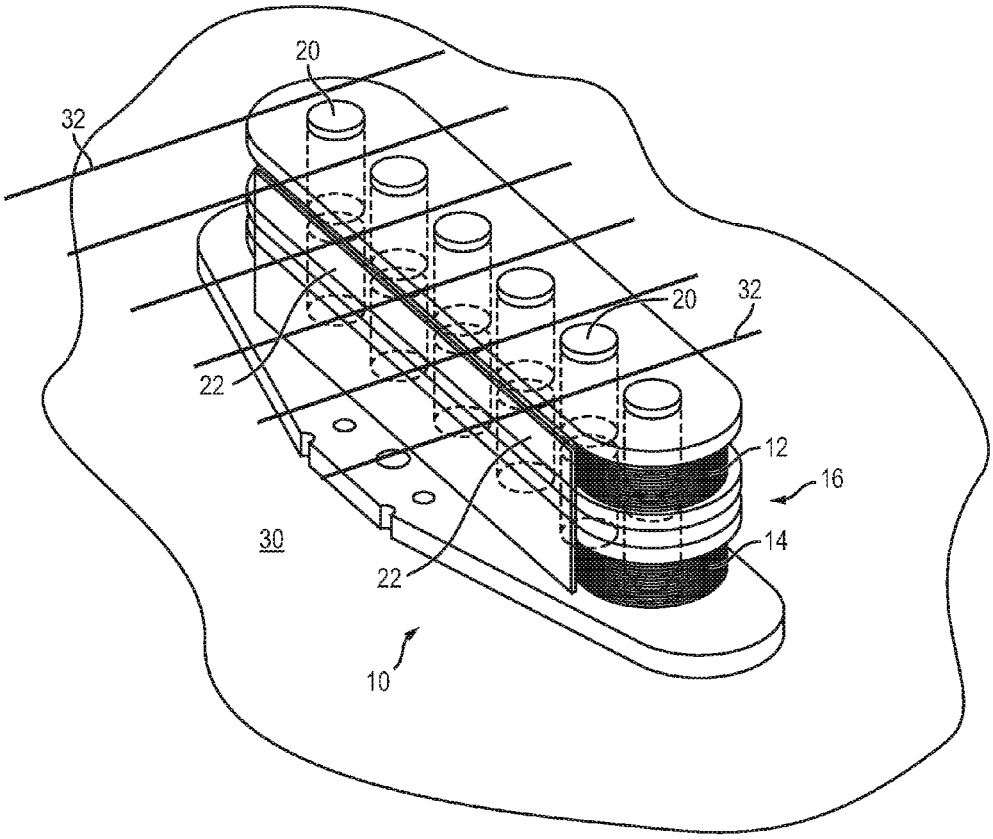
FIG. 1 (PRIOR ART)
FIG. 1 illustrates a conventional humbucking pickup with magnets oriented perpendicular to the guitar strings.
Figure 2A:
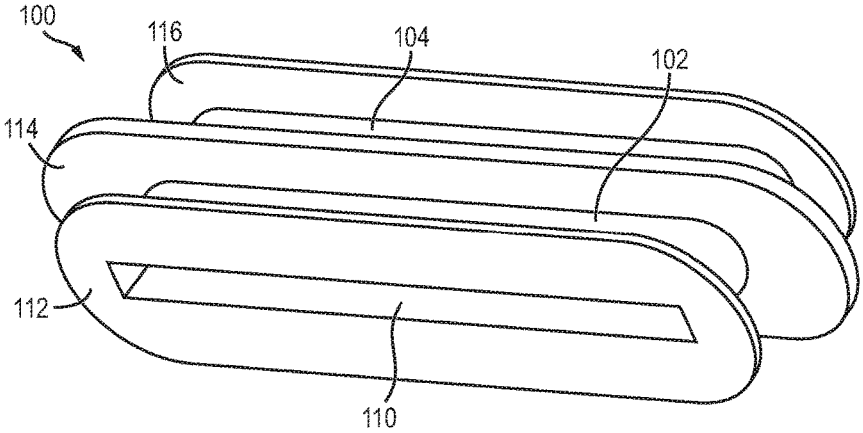
FIGS. 2*a*-2*i* illustrate a process of making a humbucking pickup with a solid magnet having opposing poles oriented in parallel to the guitar strings.

FIG. 2*a* illustrates a bobbin assembly 100 with bobbin 102 and bobbin 104 of uni-body construction with 6/6 nylon, 30% glass filled nylon, fiberglass, or other electrically insulating material. Bobbin assembly 100 includes an opening 110 extending through outer flange 112, bobbin 102, middle flange 114, bobbin 104, and outer flange 116. Outer flange 116 includes a printed circuit board or contact pads for making electrical connection to route electrical signals from the pickup to electronic components of the guitar. Opening 110 is elongated with a rectangular shape or rounded ends and extends completely through bobbin assembly 100. In one embodiment, bobbin assembly 100 has outside dimensions of 6.7 centimeters (cm) across middle flange 114 and 1.5 cm between outer flange 112 and outer flange 116. Opening 110 is 4.8 cm by 0.32 cm.

Figure 2B:
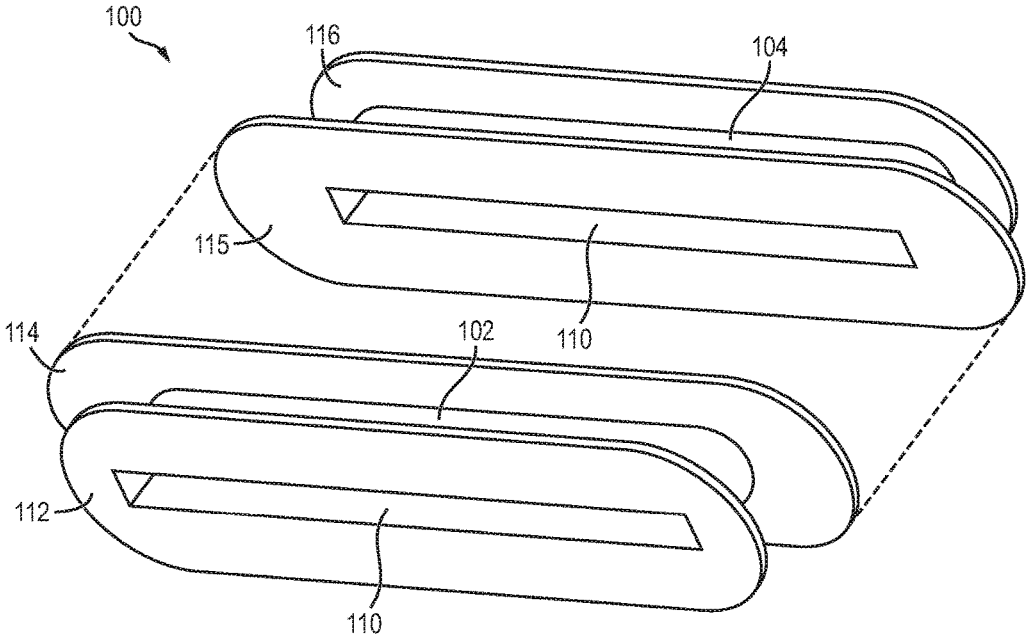

In another embodiment, FIG. 2*b* shows bobbin 102 and bobbin 104 as separate components. Opening 110 extends through flange 112, bobbin 102, and flange 114. Opening 110 further extends through flange 115, bobbin 104, and flange 116.

Figure 2C:
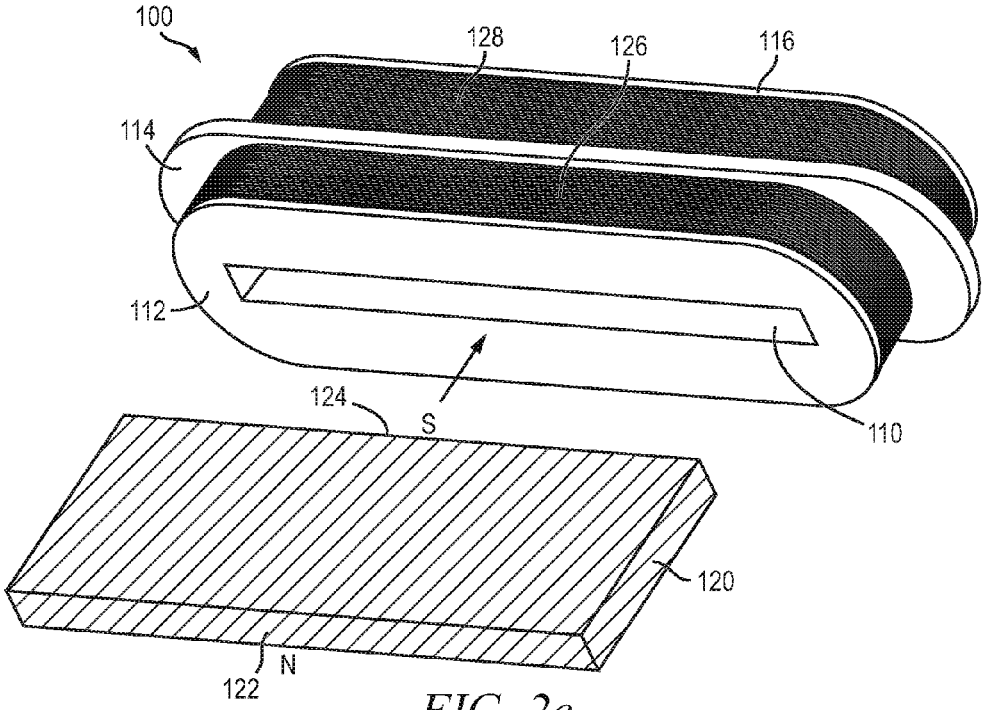

FIG. 2*c* shows a permanent magnet 120 as a solid body of core material, such as alnico or ferrite, with a north pole N designated at surface 122 and south pole S designated at surface 124. The form factor of magnet 120 matches opening 110 through bobbin assembly 100. In one embodiment, magnet 120 has dimensions of 4.8 cm by 0.32 cm by 1.5 cm. Bobbin 102 is wound with numerous turns, e.g., thousands of turns, of coated copper wire to form coil 126, and bobbin 104 is likewise wound with numerous turns of copper wire to form coil 128. Coil 126 and coil 128 are wound or connected in opposition around bobbins 102 and 104, respectively, to cancel external interference.

Figure 2D:
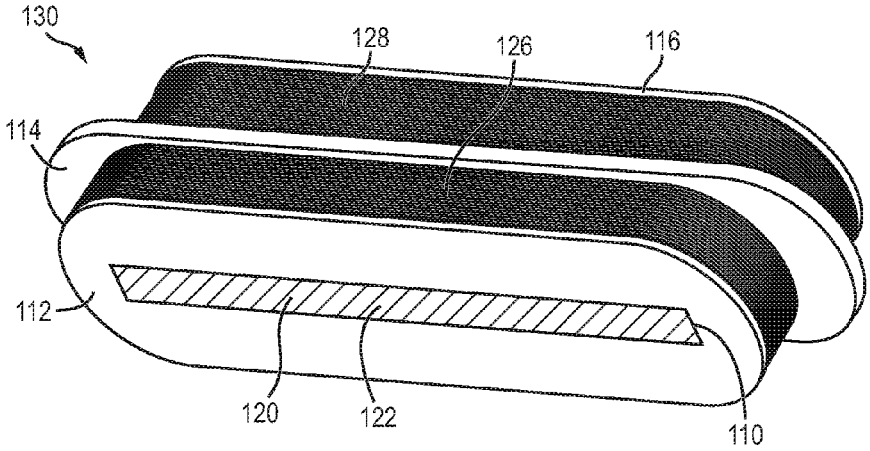

FIG. 2*d* shows permanent magnet 120 press fit or friction fit into opening 110 of bobbin assembly 100 with surface 122 flush or coplanar with outer flange 112 and surface 124 flush or coplanar with outer flange 116. In another embodiment, surface 122 extends outward beyond a surface of outer flange 112, and surface 124 extends outward beyond a surface of outer flange 116. Bobbin assembly 100 with coil 126 and coil 128, and permanent magnet 120 inserted into opening 110 constitute humbucking pickup 130.

Figure 2E:
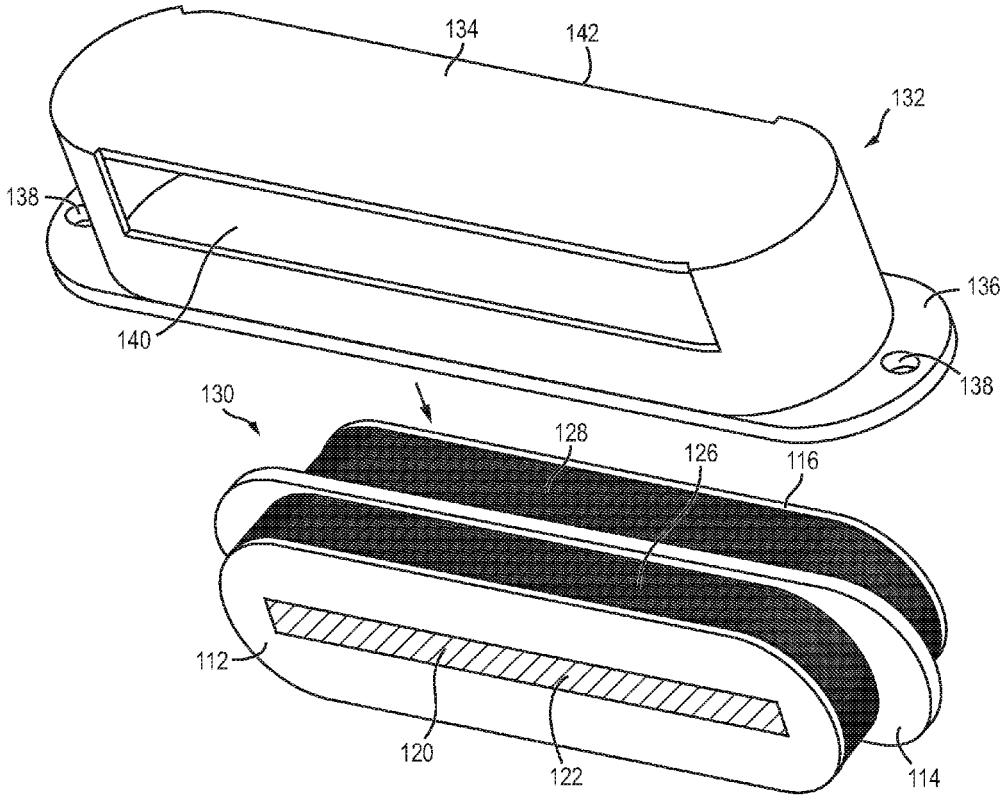

In FIG. 2*e*, housing cover 132 includes top surface 134 and mounting flange 136 with openings 138 for securing attachment to the guitar body. Opposing sides of housing cover 132 include openings 140 and 142. Humbucking pickup 130 is positioned over housing cover 132 with opening 140 vertically aligned with outer flange 112 and surface 122 of permanent magnet 120, and opening 142 vertically aligned with outer flange 116 and surface 124 of the permanent magnet.

Figure 2F:
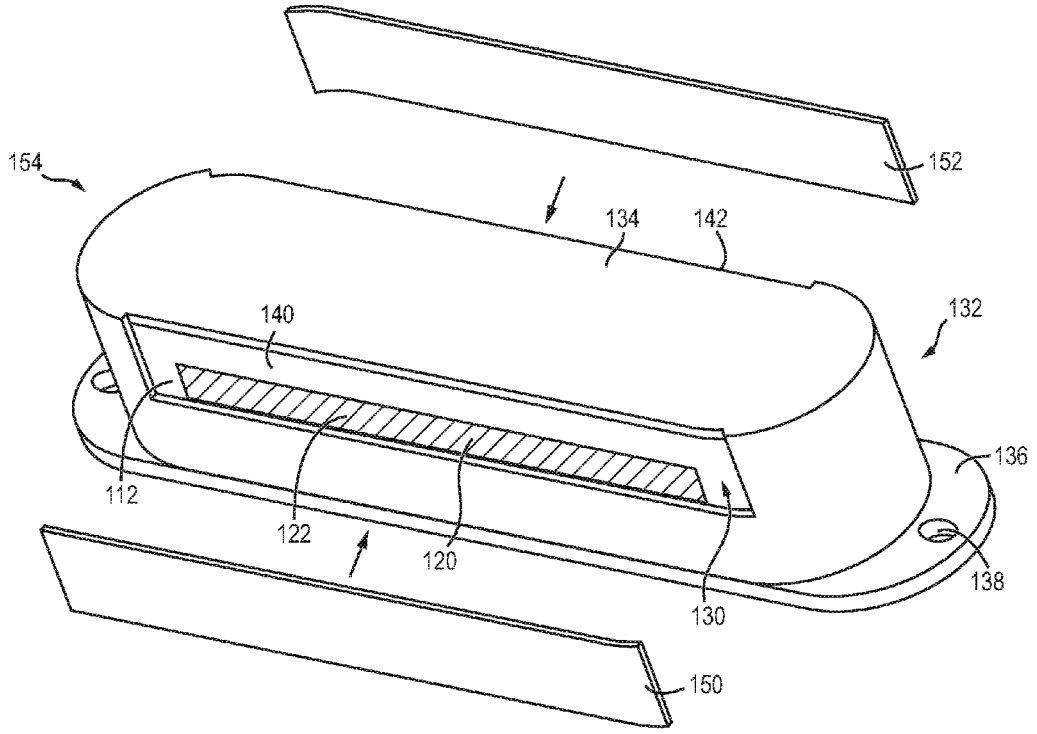

FIG. 2*f* shows humbucking pickup 130 enclosed within housing cover 132. In particular, humbucking pickup 130 is disposed within housing cover 132 so that north pole N surface 122 of permanent magnet 120 is oriented toward opening 140 and south pole S surface 124 is oriented toward opening 142 of the permanent magnet. Accordingly, the body and opposing poles of permanent magnet 120 are oriented in parallel to top surface 134 and ultimately will be oriented in parallel to the guitar strings and guitar body. Blade 150 is mounted to an exterior surface of housing cover 132 in a form-fitted slot of opening 140 over surface 122 of permanent magnet 120 with an adhesive, screws, magnetically, or other securing mechanism. Likewise, blade 152 is mounted to an exterior surface of housing cover 132 in a form-fitted slot of opening 142 over surface 124 of permanent magnet 120, as the final centerless centerpoint humbucking pickup assembly 154. Blades 150 and 152 can be mounted to an interior side surface of housing cover 132. Blades 150 and 152 are made with steel and redirect the lines of magnetic flux of permanent magnet 120 toward the guitar strings. Humbucking pickup assembly 154 exhibits a centerless centerpoint operation by nature of permanent magnet 120 extending completely through coils 126 and 128 in bobbin assembly 100 in parallel to the guitar strings, and blades 150 and 152 picking up guitar string motion at two points, i.e. proximate to the north pole N surface 122 of permanent magnet 120 and proximate to the south pole S surface 124 of the permanent magnet, neither of which exhibits a central pickup point as found in conventional pickups.

Figure 2G:
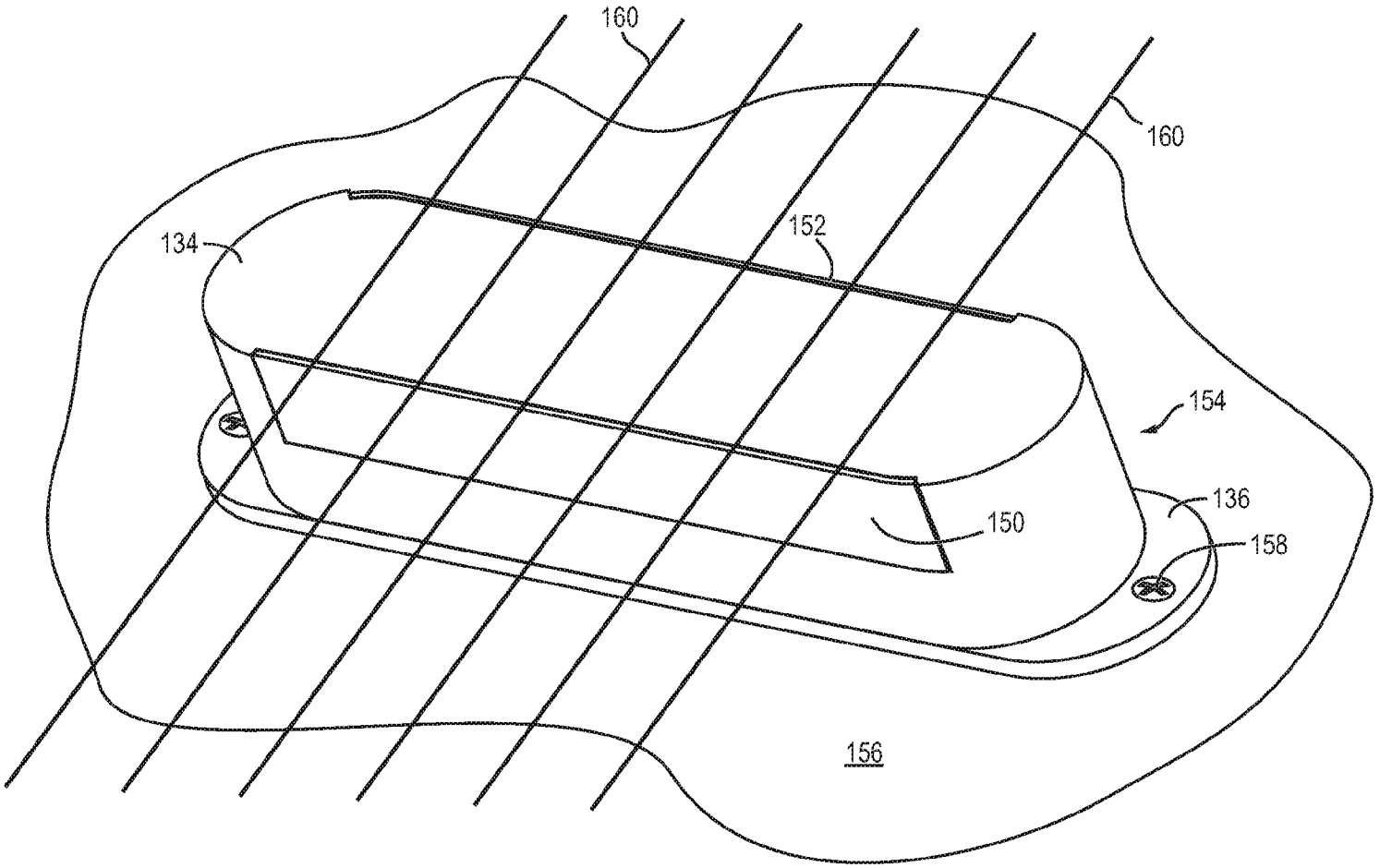

FIG. 2*g* shows humbucking pickup assembly 154 mounted to guitar body 156 with screws 158 fastened through openings 138 in mounting flange 136. Screws 158 can be used to adjust the height of humbucking pickup assembly 154 relative to strings 160. The body and opposing poles of permanent magnet 120 are oriented in parallel with a surface of guitar body 156. Six guitar strings 160 are routed across top surface 134 of housing cover 132. Given the orientation of permanent magnet 120 in housing cover 132, the longitudinal axis of strings 160 run parallel with the north pole N surface 122 and south pole S surface 124 of the permanent magnet, as shown in the cutaway view of FIG. 2*h*.

Figure 2H:
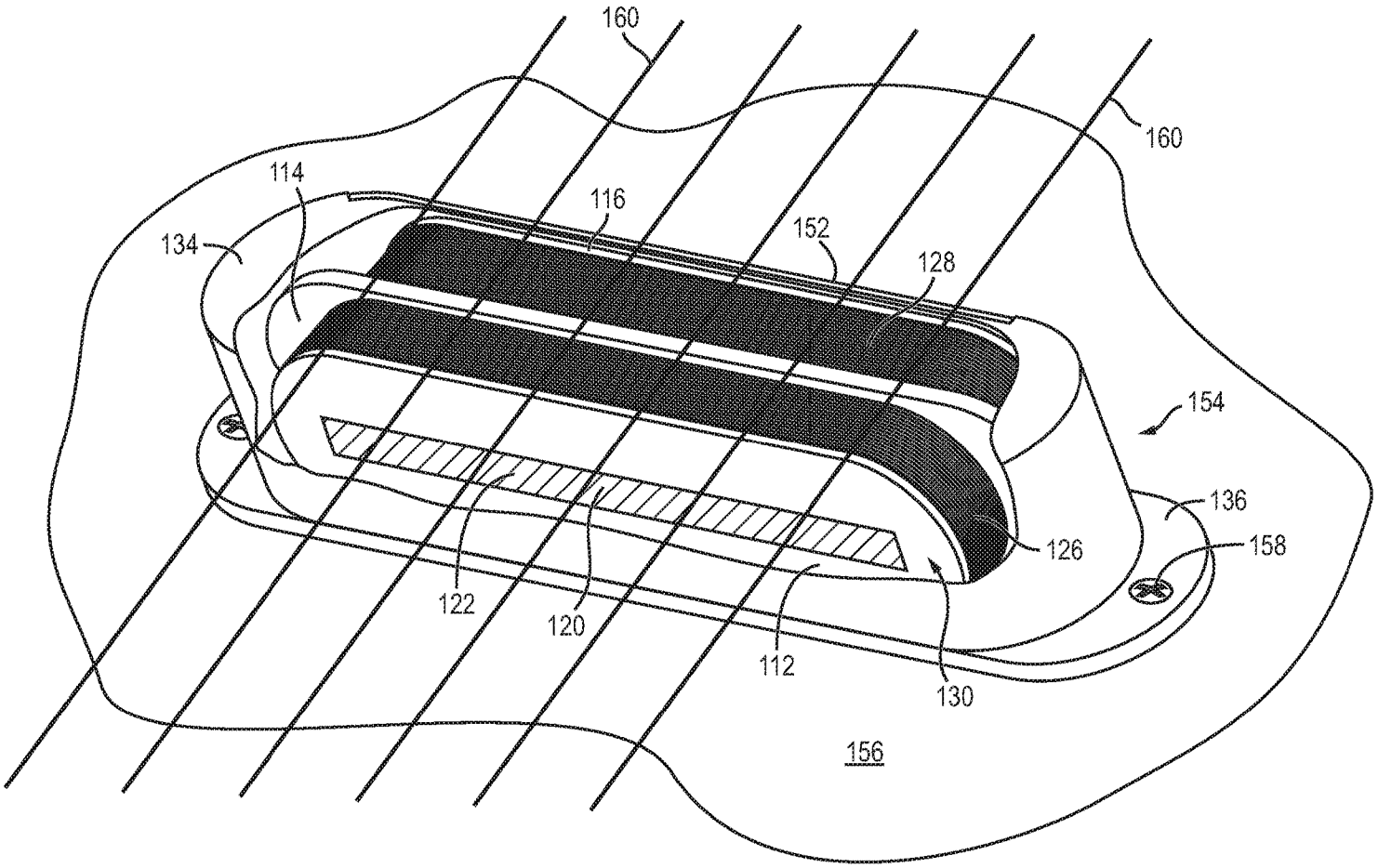
Figure 2I:
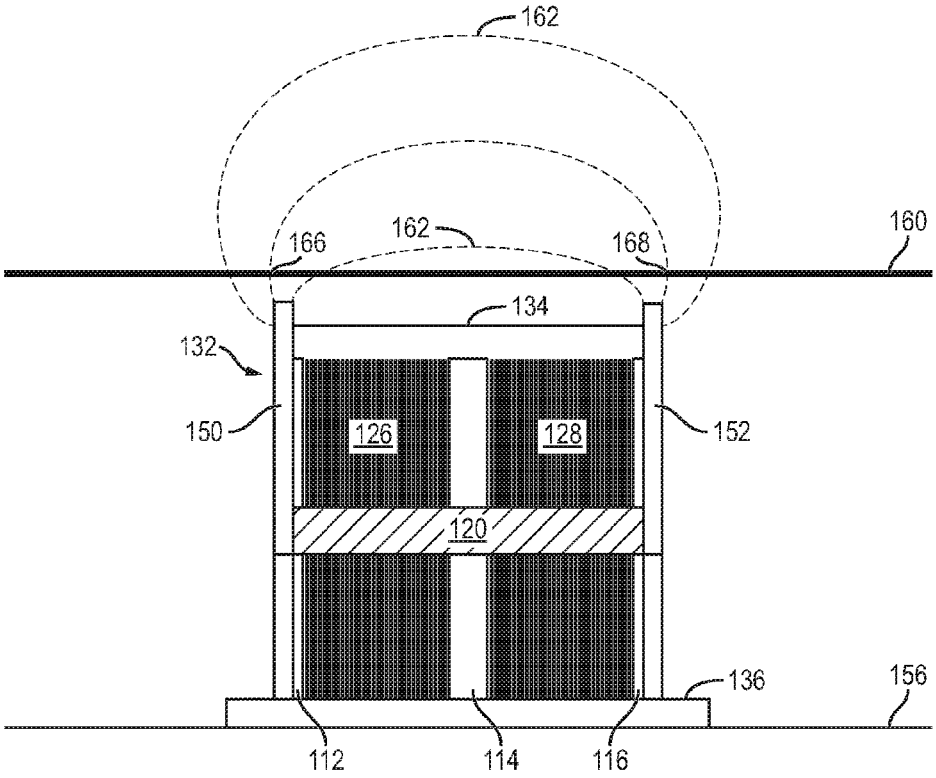

FIG. 2*i* shows strings 160 in magnetic field 162 of permanent magnet 120. Blades 150 and 152 redirect the lines of magnetic flux of permanent magnet 120 toward guitar strings 160. Humbucking pickup assembly 154 responds to movement of strings 160 at point 166 and point 168, i.e., proximate to blade 150 and the north pole N surface 122 of permanent magnet 120, and proximate to blade 152 and the south pole S surface 124.

In another embodiment, blades 150 and 152 may extend above top surface 134 of housing cover 132, see FIG. 2*i*. A plurality of notches can be cut into blades 150 and 152 to set the response of humbucking pickup 154 to different gauges of guitar strings, similar to FIG. 4*f*.

Figure 3:
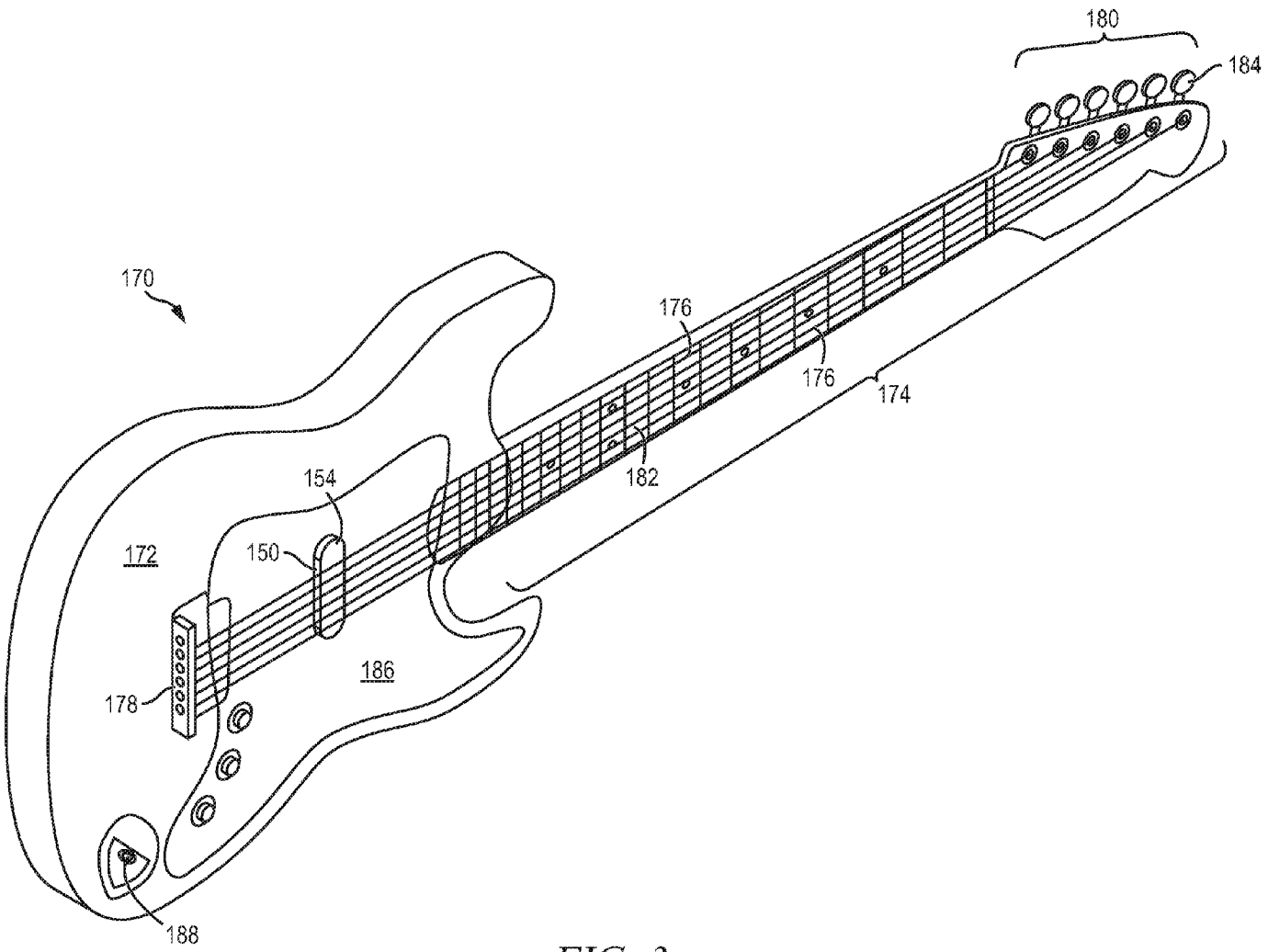
FIG. 3 illustrates an electric guitar with the humbucking pickup of FIGS. 2*a*-2*i;*

FIG. 3 illustrates guitar 170 including body 172, neck 174, and strings 176. Guitar 170 can be an electric guitar, electric bass guitar, or any other string musical instrument incorporating magnetic pickups. A bridge 178 is affixed to body 172 using adhesive, screws, clips, or other suitable attachment mechanism. Bridge 178 anchors and supports one end of strings 176. Neck 174 of electric guitar 170 includes headstock 180 and fretboard 182. Machine heads 184 are attached to headstock 180 and anchor an opposite end of strings 176. The tension of strings 176 is adjusted and guitar 170 is tuned by turning machine heads 184. A pickguard or scratch plate 186 is attached to body 172.

Humbucking pickup assembly 154 is mounted to body 172 using adhesive, screws, clips, or other suitable attachment mechanism. Humbucking pickup assembly 154 is disposed under strings 176 to convert string movement to electrical signals representative of the intended sounds from the vibrating strings. An audio output jack 188 is provided on body 172. The electrical signals generated by humbucking pickup assembly 154 are output from guitar 170 through audio output jack 188. The audio signals and control signals are routed from audio output jack 188 to external devices, e.g., an amplifier and speaker, for signal conditioning and sound reproduction.

In particular, permanent magnet 120 of humbucking pickup assembly 154 is oriented in parallel to guitar strings 176. The longitudinal axis of strings 176 run parallel with an axis between the north pole N surface 122 and south pole S surface 124 of permanent magnet 120. Permanent magnet 120 creates a magnetic field and strings 176 are routed through the magnetic field. When electric guitar 170 is played, the motion of the vibrating steel strings 176 disturbs the magnetic field, and the changes the magnetic flux to induce a voltage in coils 126 and 128, as shown in FIG. 2*h*. The changes in voltage from the vibrating string produces a current in coil representative of the string motion and, correspondingly, the sound intended by the player. The pickup operates as a transducer or variable reluctance sensor that converts mechanical string vibrations to an electrical signal that is routed to an amplifier and loudspeaker to reproduce an audible sound.

Coil 126 and coil 128 in humbucking pickup assembly 154 are wound or connected in opposition. Any external interference, e.g., ambient hum from power-supply transformers, radio frequencies, or electrical devices reaches coils 126 and 128 as common-mode noise, induces an equal and opposite voltage in each coil which tends to cancel each other out. Accordingly, the parallel orientation of permanent magnet 120 in humbucking pickup assembly 154 with respect to guitar strings 176 produces a voltage in coils representative of the string motion and, correspondingly, the sound intended by the player. The opposing windings or connection of coil 126 and coil 128 induces an equal and opposite voltage in each coil to cancel out external interference. Humbucking pickup assembly 154 with permanent magnet 120 oriented in parallel to guitar strings 176 achieves the desired interference cancellation with a single magnet in a smaller form factor, i.e., similar to the form factor of a single coil pickup.

Figure 4A:
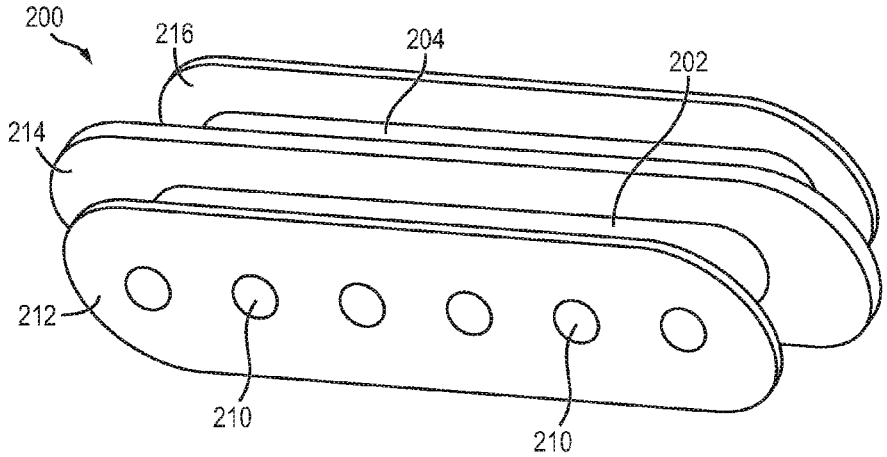
FIGS. 4*a*-4*h* illustrate a process of making a humbucking pickup with a plurality of magnets oriented in parallel to the guitar strings.

FIGS. 4*a*-4*h* illustrate another embodiment with individual separate permanent magnets extending through the humbucking pickup. FIG. 4*a* shows bobbin assembly 200 with bobbin 202 and bobbin 204 of uni-body construction with 6/6 nylon, 30% glass filled nylon, fiberglass, or other electrically insulating material. Bobbin assembly 200 includes a plurality of tubular openings 210 extending through outer flange 212, bobbin 202, middle flange 214, bobbin 204, and outer flange 216. Outer flange 216 includes a printed circuit board or contact pads for making electrical connection to route electrical signals from the pickup to electronic components of the guitar. Tubular openings 210 extend completely through bobbin assembly 200. In one embodiment, bobbin assembly 200 has outside dimensions of 6.7 cm across middle flange 114 and 1.5 cm between outer flange 212 and outer flange 216. Tubular openings 210 are 0.32 cm in diameter.

Figure 4B:
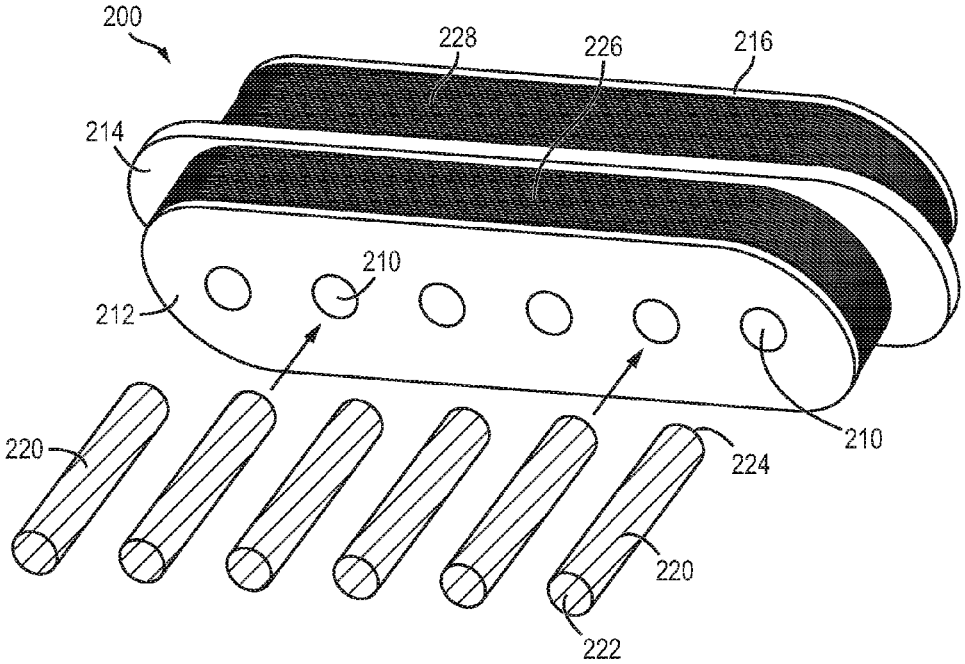

FIG. 4*b* shows a plurality of permanent magnets 220, each with a solid body of core material, such as alnico or ferrite, with a north pole N designated at surface 222 and south pole S designated at surface 224. In one embodiment, magnets 220 have dimensions of 0.32 cm in diameter and 1.5 cm in length. Bobbin 202 is wound with numerous turns, e.g., thousands of turns, of coated copper wire to form coil 226, and bobbin 204 is likewise wound with numerous turns of copper wire to form coil 228. Coil 226 and coil 228 are wound or connected in opposition around bobbins 202 and 204, respectively, to cancel external interference.

Figure 4C:
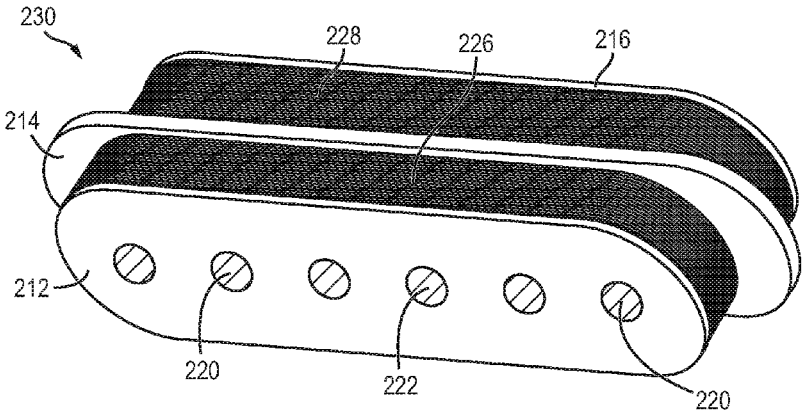

FIG. 4*c* shows permanent magnets 220 press fit or friction fit into openings 210 of bobbin assembly 200 with surfaces 222 flush or coplanar with outer flange 212 and surfaces 224 flush or coplanar with outer flange 216. In another embodiment, surfaces 222 extend outward beyond a surface of outer flange 222, and surfaces 124 extend outward beyond a surface of outer flange 216. Bobbin assembly 200 with coil 226 and coil 228, and permanent magnets 220 inserted into openings 210 constitute humbucking pickup 230.

Figure 4D:
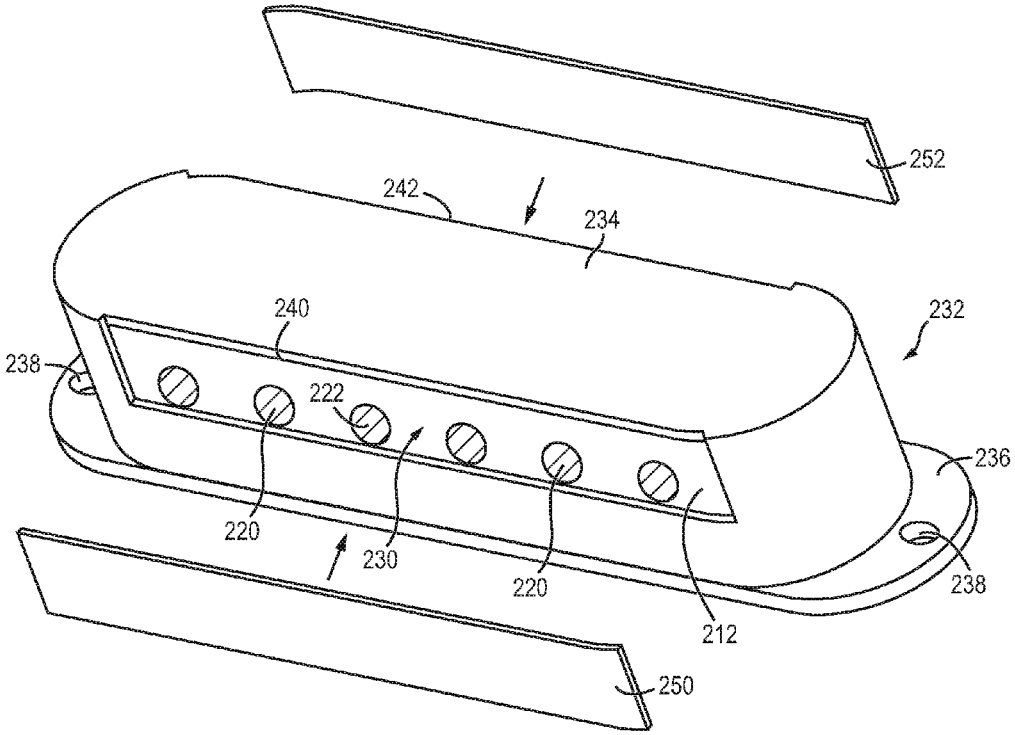

In FIG. 4*d*, housing cover 232 includes top surface 234 and mounting flange 236 with openings 238 for securing attachment to the guitar body. Opposing sides of housing cover 232 include openings 240 and 242. Humbucking pickup 230 is positioned over housing cover 232 with opening 240 vertically aligned with outer flange 212 and surfaces 222 of permanent magnets 220, and opening 242 vertically aligned with outer flange 216 and surfaces 224 of the permanent magnets. Humbucking pickup 230 is then enclosed within housing cover 232. In particular, humbucking pickup 230 is disposed within housing cover 232 so that north pole N surfaces 222 of permanent magnets 220 are oriented toward opening 240 and south pole S surfaces 224 are oriented toward opening 242 of the permanent magnet. Accordingly, the body and opposing poles of permanent magnets 220 are oriented in parallel to top surface 234 and ultimately will be oriented in parallel to the guitar strings and guitar body. Blade 250 is positioned over opening 240 and blade 252 is positioned over opening 242.

Figure 4E:
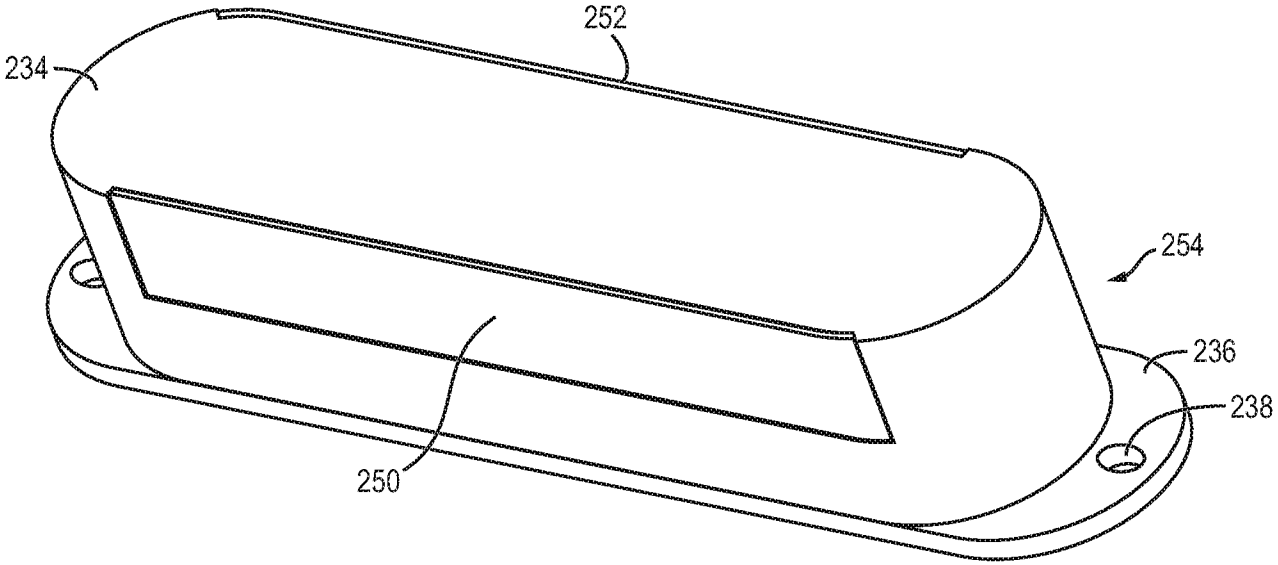

FIG. 4*e* shows blade 250 mounted to an exterior surface of housing cover 232 in a form-fitted slot of opening 240 over surfaces 222 of permanent magnets 220 with an adhesive, screws, magnetically, or other securing mechanism. Likewise, blade 252 is mounted to an exterior surface of housing cover 232 in a form-fitted slot of opening 242 over surfaces 224 of permanent magnets 220, as the final centerless centerpoint humbucking pickup assembly 254. Blades 250 and 252 are made with steel and redirect the lines of magnetic flux of permanent magnets 220 toward the guitar strings. Humbucking pickup assembly 254 exhibits a centerless centerpoint operation by nature of permanent magnets 220 extending completely through coils 226 and 228 in bobbin assembly 200 in parallel to the guitar strings, and blades 250 and 252 picking up guitar string motion at two points, i.e. proximate to the north pole N surfaces 222 of permanent magnets 220 and proximate to the south pole S surfaces 224 of the permanent magnets, neither of which exhibits a central pickup point as found in conventional pickups.

Figure 4F:
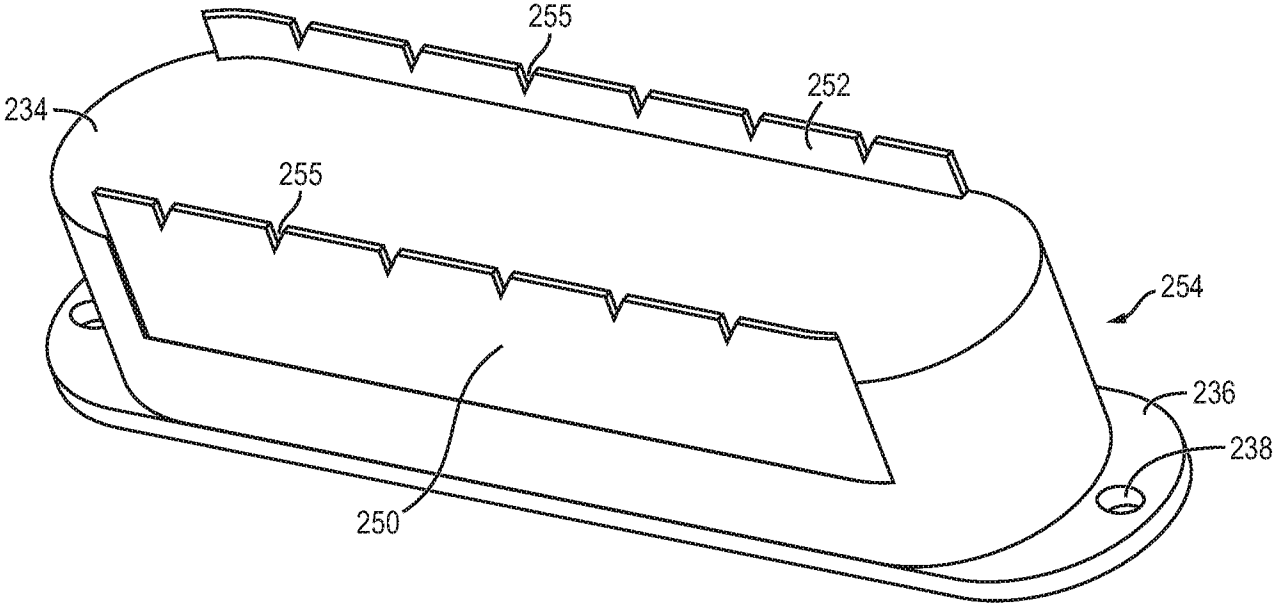

In another embodiment, blades 250 and 252 can be mounted to an interior side surface of housing cover 232. Blades 250 and 252 may extend above top surface 234 of housing cover 232, as shown in FIG. 4*f*. A plurality of notches 255 can be cut into blades 250 and 252 to set the response of humbucking pickup 254 to different gauges of guitar strings.

Figure 4G:
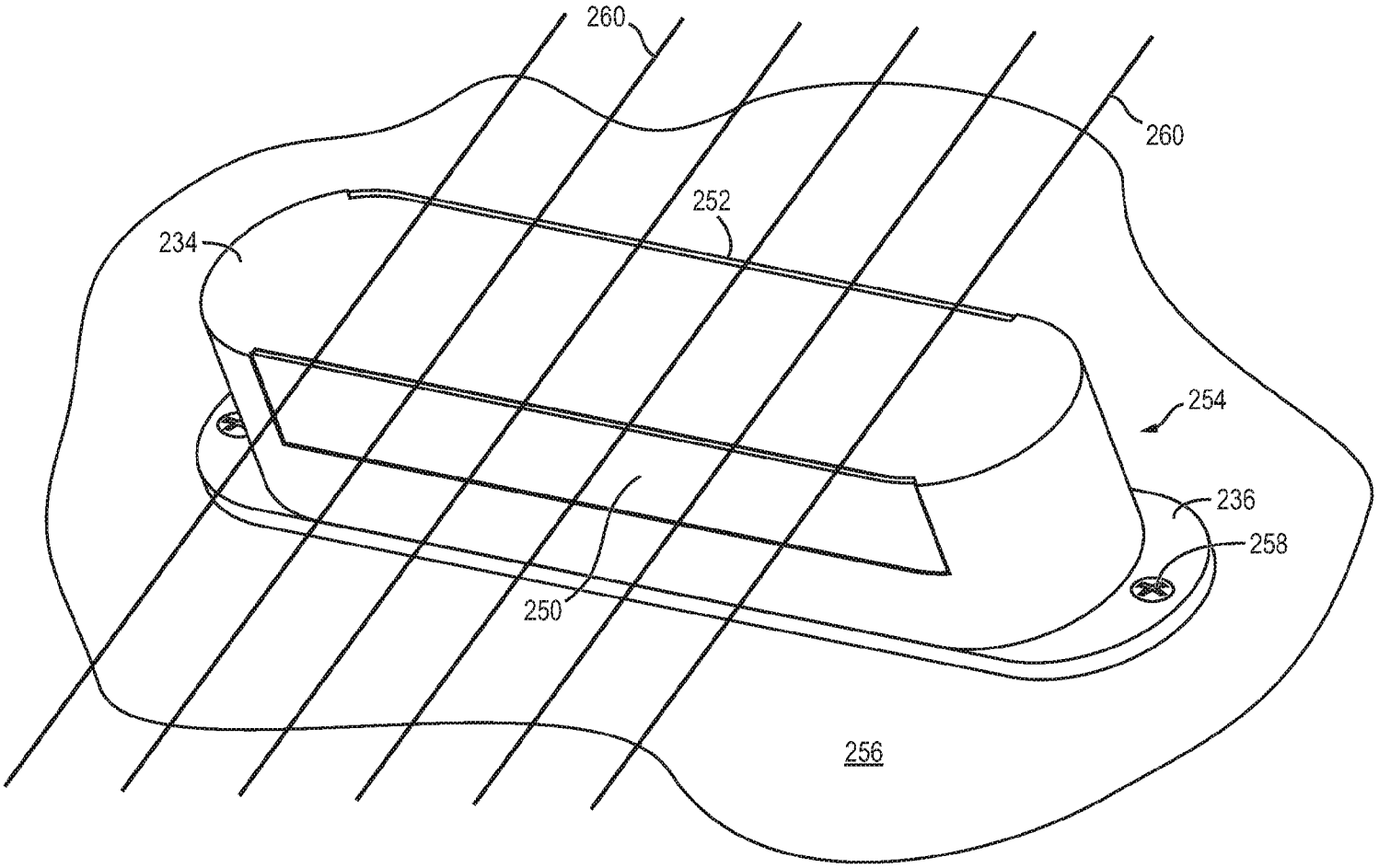
Figure 4H:
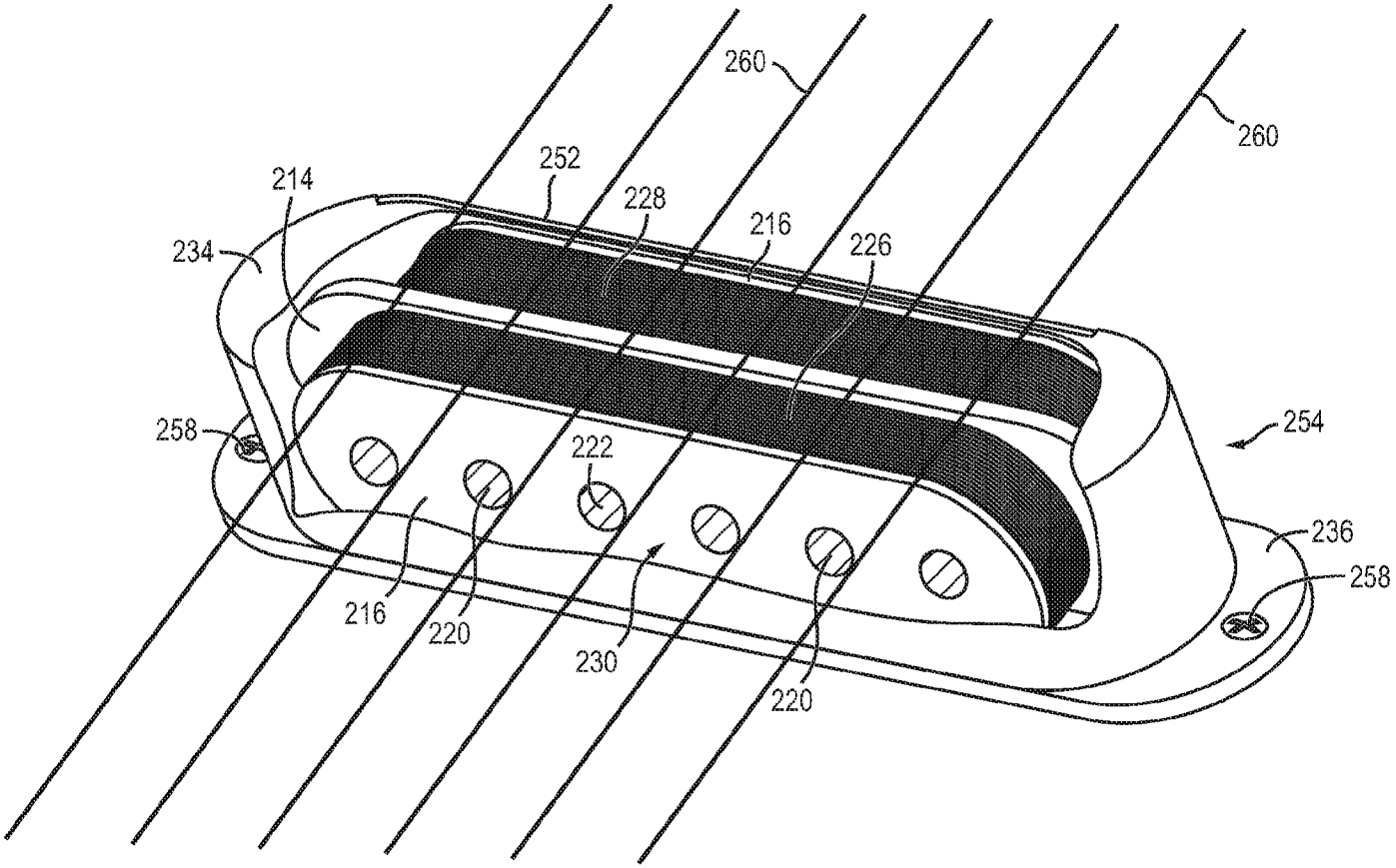

FIG. 4*g* shows humbucking pickup assembly 254 mounted to guitar body 256 with screws 258 fastened through openings 238 in mounting flange 236. Screws 258 can be used to adjust the height of humbucking pickup assembly 254, relative to strings 260. The body and opposing poles of permanent magnets 220 are oriented in parallel with a surface of guitar body 256. Six guitar strings 260 are routed across top surface 234 of housing cover 232. Given the orientation of permanent magnets 220 in housing cover 232, the longitudinal axis of strings 260 run parallel with the north pole N surfaces 222 and south pole S surfaces 224 of the permanent magnet, as shown in the cutaway view of FIG. 4*h*. As described for FIG. 2*h*, humbucking pickup assembly 254 responds to movement of strings 260 proximate to blade 250 and the north pole N surfaces 222 of permanent magnets 220 and proximate to blade 252 and the south pole S surfaces 224.

Figure 5A:
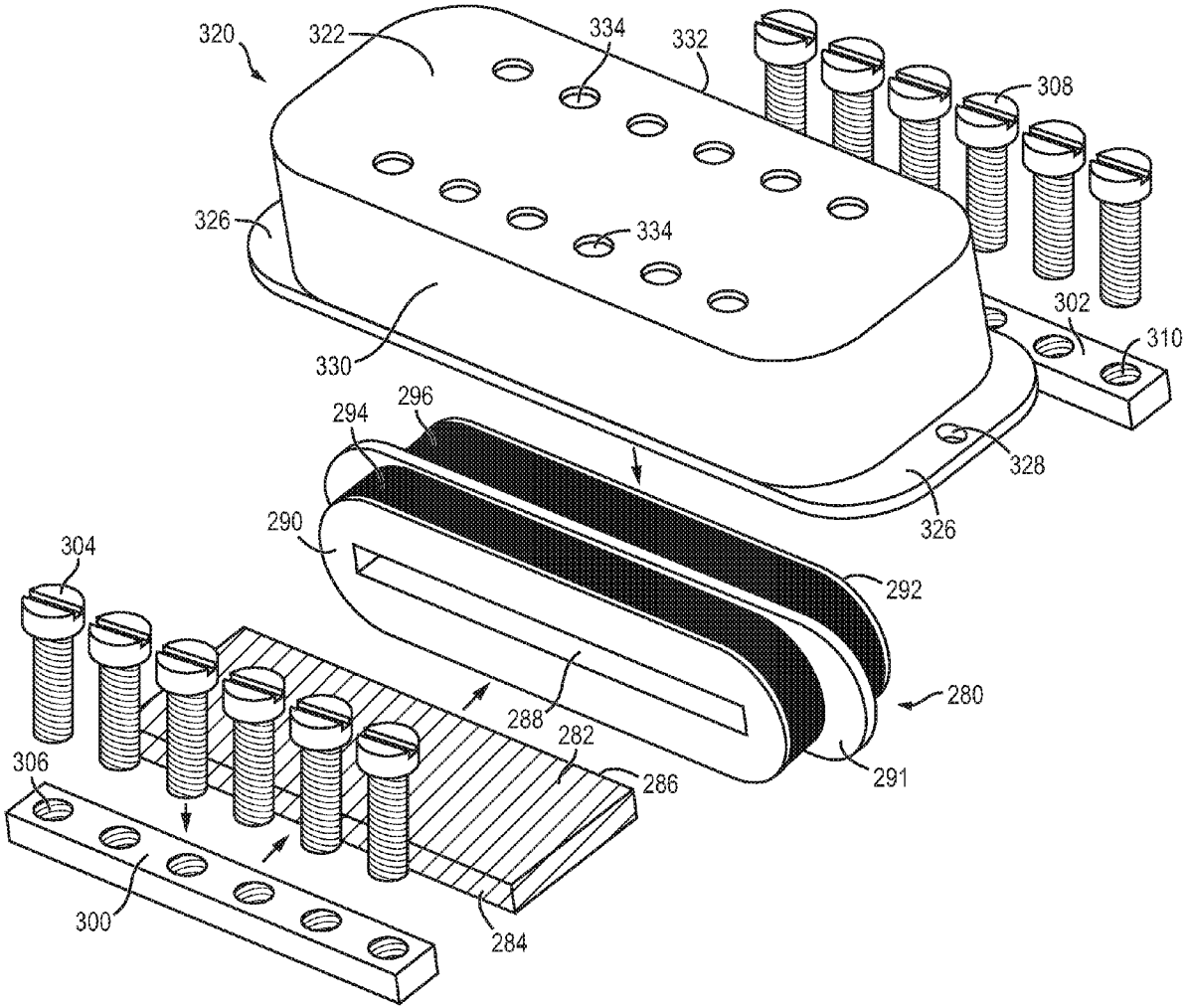
FIGS. 5*a*-5*c* illustrate a process of making a humbucking pickup with pole screws through pole shoes adjacent to a permanent magnet oriented in parallel to the strings.
Figure 5B:
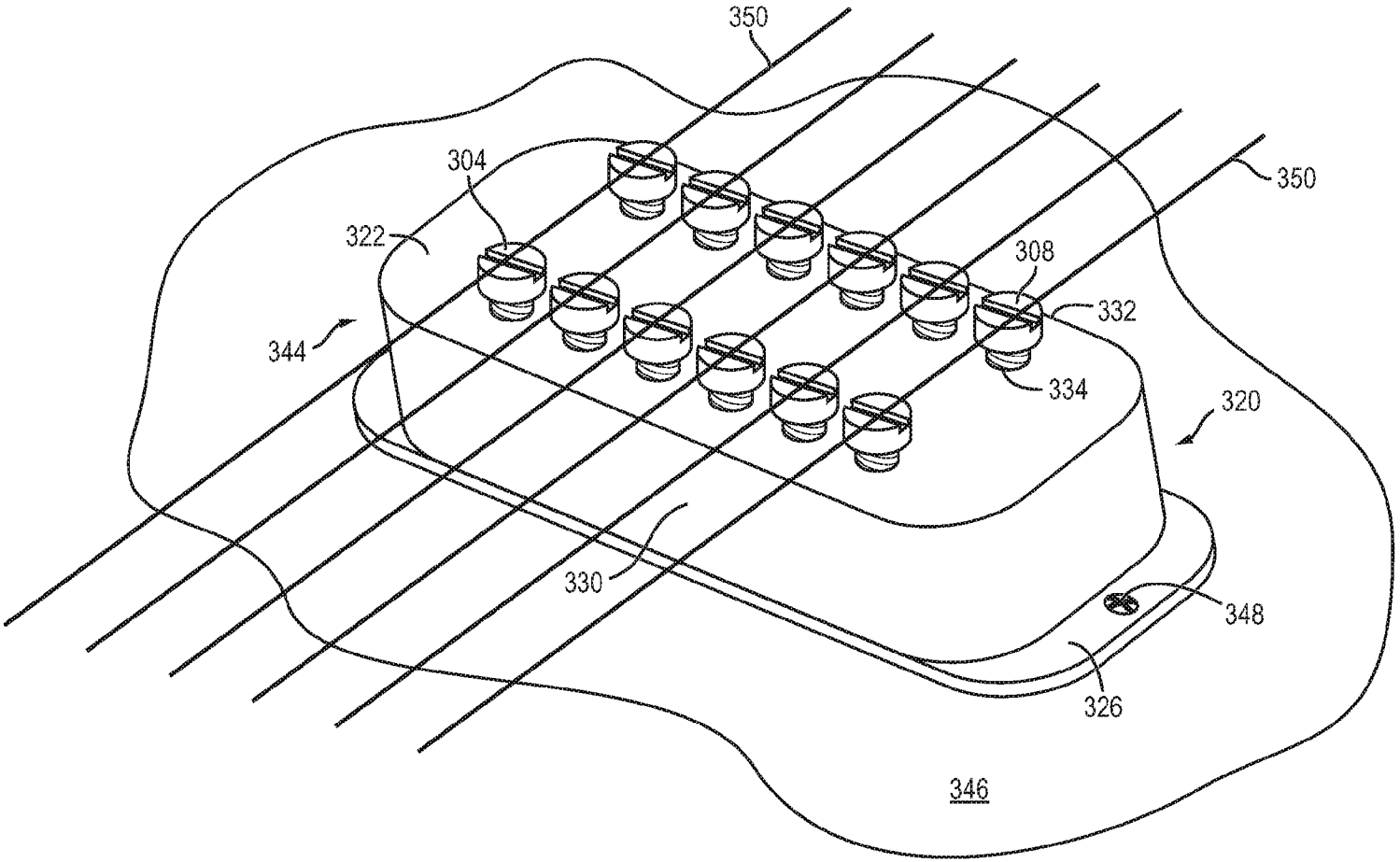
Figure 5C:
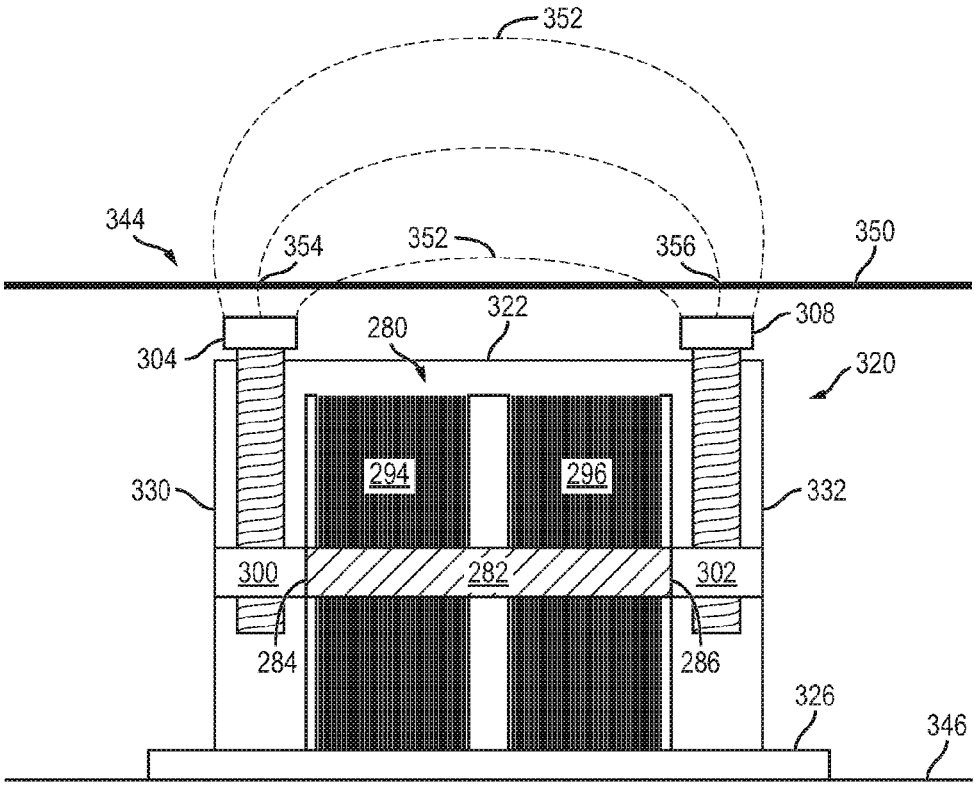

FIGS. 5*a*-5*c* illustrate humbucking pickup 280, similar to humbucking pickup 130 in FIGS. 2*a*-2*c*, with permanent magnet 282 as a solid body of core material, such as alnico or ferrite, with a north pole N designated at surface 284 and south pole S designated at surface 286. FIG. 5*a* shows the form factor of magnet 282 matching the dimensions of opening 288 through the bobbin assembly from outer flange 290 through middle flange 291 to outer flange 292. Coil 294 and coil 296 are wound or connected in opposition around the bobbin assembly to cancel external interference. Permanent magnet 282 is press fit or friction fit into opening 288 with surface 284 flush or coplanar with outer flange 290 and surface 286 flush or coplanar with outer flange 292. Alternatively, surface 284 extends outward beyond a surface of outer flange 290, and surface 286 extends outward beyond a surface of outer flange 292. The bobbin assembly with coil 294 and coil 296, and permanent magnet 282 inserted into opening 288 constitute humbucking pickup 280.

In another embodiment, humbucking pickup 280 may use a plurality of permanent magnets, similar to magnets 220 in humbucking pickup 230, disposed through coils 294 and 296 in the bobbin assembly.

Pole shoe 300 and pole shoe 302 are made of steel and magnetically coupled to the north pole N surface 284 of permanent magnet 282 and south pole S surface 286, respectively. Pole screws 304 are inserted into threaded openings 306 of pole shoe 300. Likewise, pole screws 308 are inserted into threaded openings 310 of pole shoe 302. Pole shoe 300 and pole shoe 302 operate as respective extensions of the north pole N surface 284 and the south pole S surface 286, vertically adjustable at six locations on each pole surface of permanent magnet 282 by pole screws 304 and pole screws 308. That is, pole screws 304 and pole screws 308 can be individually threaded and unthreaded in openings 306 and openings 310 to make small adjustments of the relative locations of pole shoe 300 and pole shoe 302 with respect to the north pole N surface 284 and the south pole S surface 286. The small adjustments of the relative locations of pole shoe 300 and pole shoe 302 by individual threading and unthreading pole screws 304 and pole screws 308 have the effect of altering the magnetic field relative to the guitar strings. Accordingly, the individual adjustments to pole screws 304 and pole screws 308 tailor the response of humbucking pickup 280 to different gauges of guitar strings.

In another embodiment, there are separate pole shoes, each with a threaded opening corresponding to each pole screw. Again, the pole screws can be individually threaded and unthreaded to make small adjustments of the relative locations of the individual pole shoes with respect to the north pole N surface and the south pole S surface. The separate pole shoes are particularly applicable to the embodiment of humbucking pickup 230.

Housing cover 320 includes top surface 322 and mounting flange 326 with openings 328 for securing attachment to the guitar body. Openings 334 are provided in top surface 322 to accommodate pole screws 304 and pole screws 308. Housing cover 320 is positioned over humbucking pickup 280 with side surface 330 vertically aligned with outer flange 290 and surface 284 of permanent magnet 282, and side surface 332 vertically aligned with outer flange 292 and surface 286 of the permanent magnet.

In FIG. 5*b*, humbucking pickup 280 is enclosed within housing cover 320, as the final centerless centerpoint humbucking pickup assembly 344. In particular, humbucking pickup 280 is disposed within housing cover 320 so that north pole N surface 286 of permanent magnet 282 and pole shoe 300 are oriented toward side surface 330 and the south pole S surface 286 and pole shoe 302 are oriented toward side surface 332. Pole screws 304 and pole screws 308 are accessible through openings 334 on top surface 322.

Humbucking pickup assembly 344 is mounted to guitar body 346 with screws 348 fastened through openings 328 in mounting flange 326. The body and opposing poles of permanent magnet 282 are oriented in parallel with a surface of guitar body 346. Six guitar strings 350 are routed across top surface 322 of housing cover 320. Given the orientation of permanent magnet 282 in housing cover 320, the longitudinal axis of strings 350 run parallel with the north pole N surface 284 and south pole S surface 286 of the permanent magnet. Humbucking pickup assembly 344 responds to movement of strings 350 proximate to pole screws 304 and pole screws 308. Pole screws 304 and pole screws 308 can be individually threaded and unthreaded in openings 306 and openings 310 to make small adjustments of the relative locations of pole shoe 300 and pole shoe 302 with respect to the north pole N surface 284 and the south pole S surface 286. The small adjustments of the relative locations of pole shoe 300 and pole shoe 302 by individually threading and unthreading pole screws 304 and pole screws 308 have the effect of altering the magnetic field relative to the guitar strings to tailor the response of humbucking pickup 280 to different gauges of guitar strings.

FIG. 5*c* shows a cross-sectional view of humbucking pickup assembly 344 with pole shoe 300 disposed between sidewall 330 and the north pole N surface 284, and pole shoe 302 disposed between sidewall 332 and the south pole S surface 286. Pole screw 304 and pole screw 308 redirect the lines of magnetic flux 352 of permanent magnet 282 toward guitar strings 350. Humbucking pickup assembly 344 exhibits a centerless centerpoint operation by nature of permanent magnet 282 extending completely through coils 294 and 296 in the bobbin assembly in parallel to guitar strings 350, and pole screw 304 and pole screw 308 picking up guitar string motion at point 354 and point 365 proximate to pole shoe 300 and pole shoe 302.

Figure 6A:
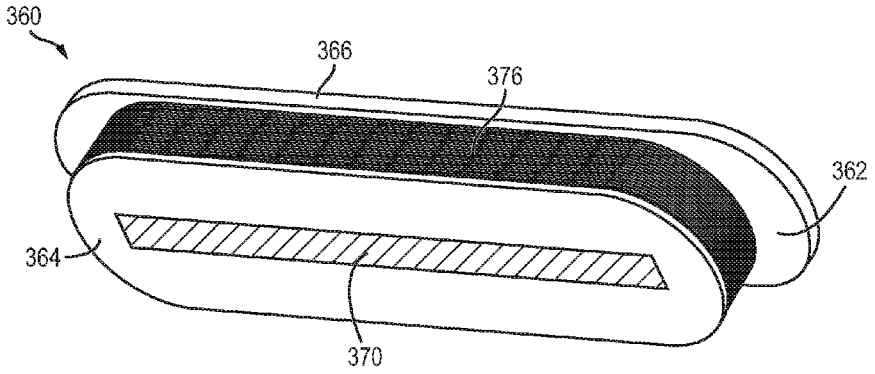
FIGS. 6*a*-6*c* illustrate a process of making a single coil pickup with a solid magnet having opposing poles oriented in parallel to the guitar strings.

FIG. 6*a* illustrates another embodiment of a single coil pickup 360 with bobbin 362 of uni-body construction with 6/6 nylon, 30% glass filled nylon, fiberglass, or other electrically insulating material. An opening extends through outer flange 364, bobbin 362, and outer flange 366. Permanent magnet 370 has a solid body of core material, such as alnico or ferrite, with a north pole N surface and south pole S surface. The form factor of magnet 370 matches the opening through bobbin 362. Permanent magnet 370 is press fit or friction fit into the opening of bobbin 362 with the north pole N surface flush or coplanar with outer flange 364 and the south pole S surface flush or coplanar with outer flange 366. In another embodiment, the north pole N surface extends outward beyond a surface of outer flange 364, and the south pole S surface extends outward beyond a surface of outer flange 366. Bobbin 362 is wound with numerous turns, e.g., thousands of turns, of coated copper wire to form coil 376.

Figure 6B:
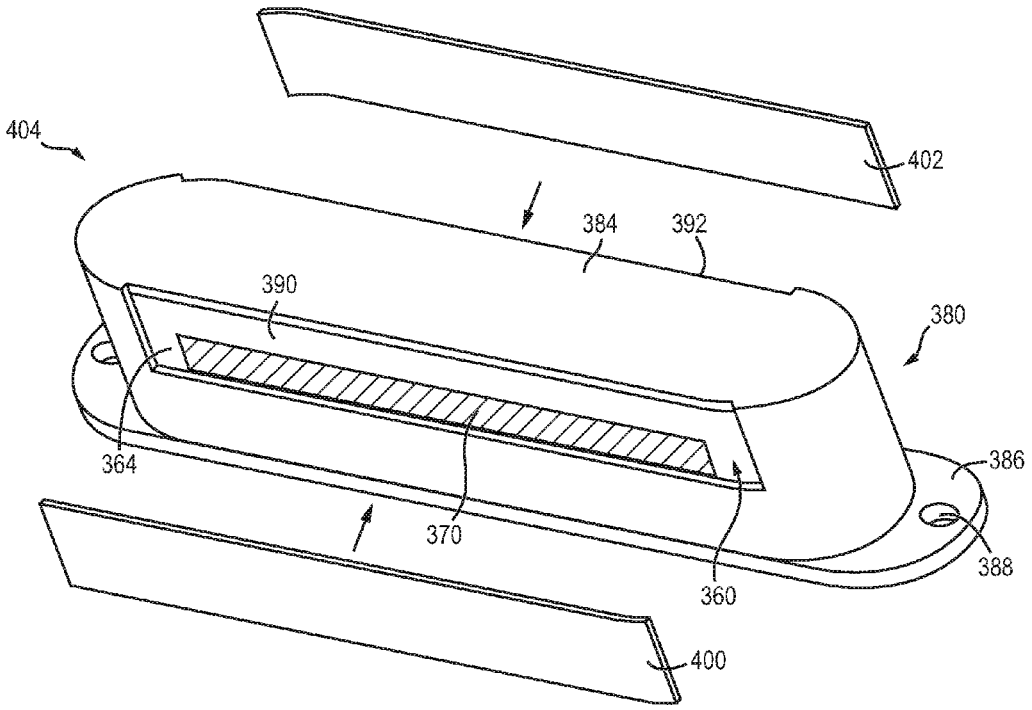

In FIG. 6*b*, housing cover 380 includes top surface 384 and mounting flange 386 with openings 388 for securing attachment to the guitar body. Opposing sides of housing cover 380 include openings 390 and 392. Single coil pickup 360 is positioned over housing cover 380 with opening 390 vertically aligned with outer flange 364 and the north pole N surface of permanent magnet 370, and opening 392 vertically aligned with outer flange 366 and the south pole S surface of the permanent magnet.

Single coil pickup 360 is disposed within housing cover 380 so that north pole N surface of permanent magnet 370 is oriented toward opening 390 and south pole S surface is oriented toward opening 392 of the permanent magnet. Accordingly, the body and opposing poles of permanent magnet 370 are oriented in parallel to top surface 384 and ultimately will be oriented in parallel to the guitar strings and guitar body. Blade 400 is mounted to an exterior surface of housing cover 380 in a form-fitted slot of opening 390 over the north pole N surface of permanent magnet 370 with an adhesive, screws, magnetically, or other securing mechanism. Likewise, blade 402 is mounted to an exterior surface of housing cover 360 in a form-fitted slot of opening 392 over the south pole S surface of permanent magnet 370, as the final centerless centerpoint single coil pickup assembly 404. Blades 400 and 402 can be mounted to an interior side surface of housing cover 360. Blades 400 and 402 are made with steel and redirect the lines of magnetic flux of permanent magnet 370 toward the guitar strings. Single coil pickup assembly 404 exhibits a centerless centerpoint operation by nature of permanent magnet 370 extending completely through coils 376 in bobbin 362 in parallel to the guitar strings, and blades 400 and 402 picking up guitar string motion at two points, i.e. proximate to the north pole N surface of permanent magnet 370 and proximate to the south pole S surface of the permanent magnet, neither of which exhibits a central pickup point as found in conventional pickups.

Figure 6C:
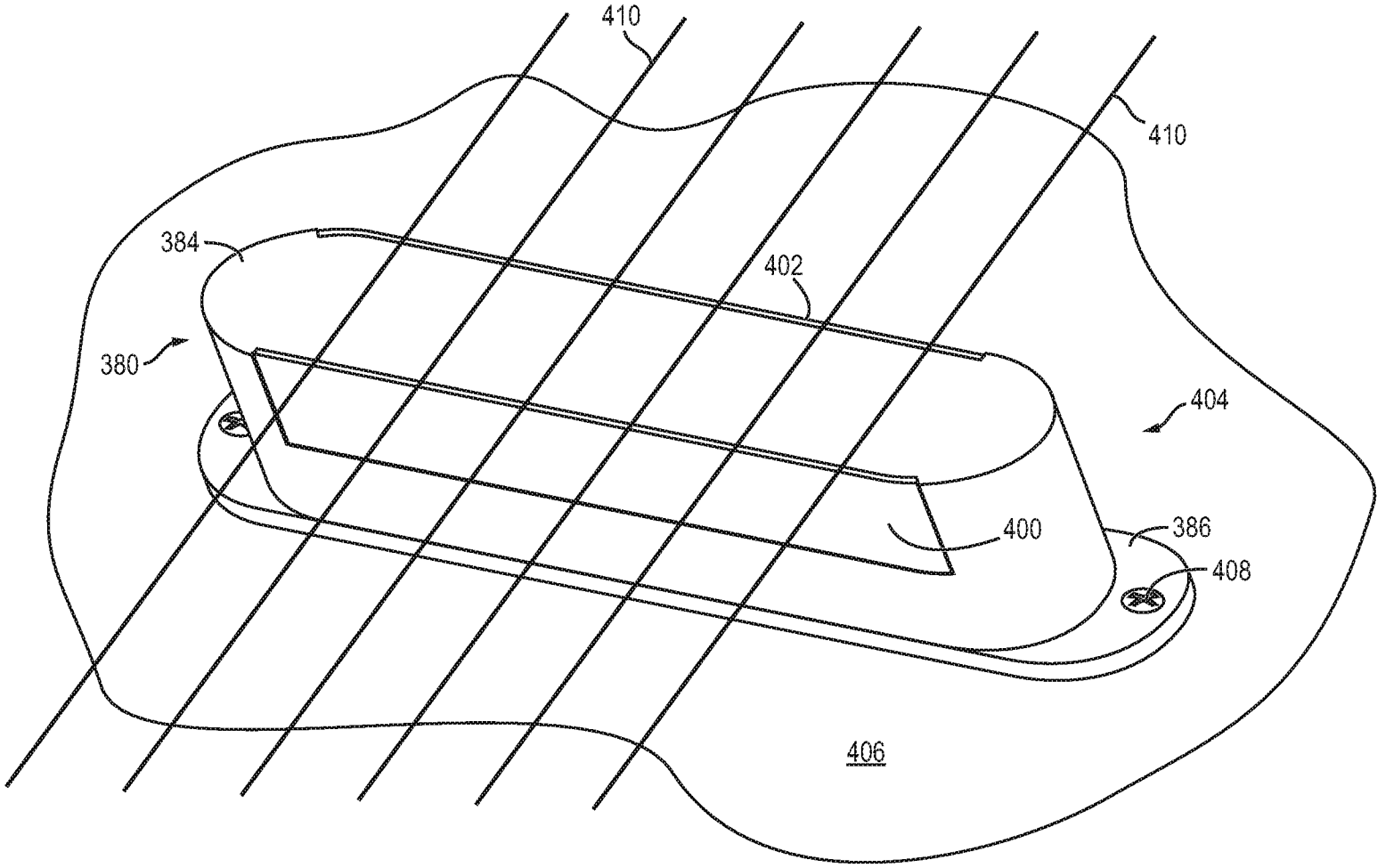

FIG. 6*c* shows single coil pickup assembly 404 mounted to guitar body 406 with screws 408 fastened through openings 388 in mounting flange 386. Screws 408 can be used to adjust the height of single coil pickup assembly 404 relative to strings 410. The body and opposing poles of permanent magnet 370 are oriented in parallel with a surface of guitar body 406. Six guitar strings 410 are routed across top surface 384 of housing cover 380. Given the orientation of permanent magnet 370 in housing cover 380, the longitudinal axis of strings 410 run parallel with the north pole N surface and south pole S surface of the permanent magnet.

Strings 410 vibrate in the magnetic field of permanent magnet 370, similar to FIG. 2*i*. Blades 400 and 402 redirect the lines of magnetic flux of permanent magnet 370 toward guitar strings 410. Single coil pickup assembly 404 responds to movement of strings 410 at points proximate to blade 400 and the north pole N surface of permanent magnet 370 and proximate to blade 402 and the south pole S surface of the permanent magnet.

In another embodiment, blades 400 and 402 may extend above top surface 384 of housing cover 380. A plurality of notches can be cut into blades 400 and 402 to set the response of single coil pickup assembly 404 to different gauges of guitar strings, similar to FIG. 4*f*.

Figure 7:
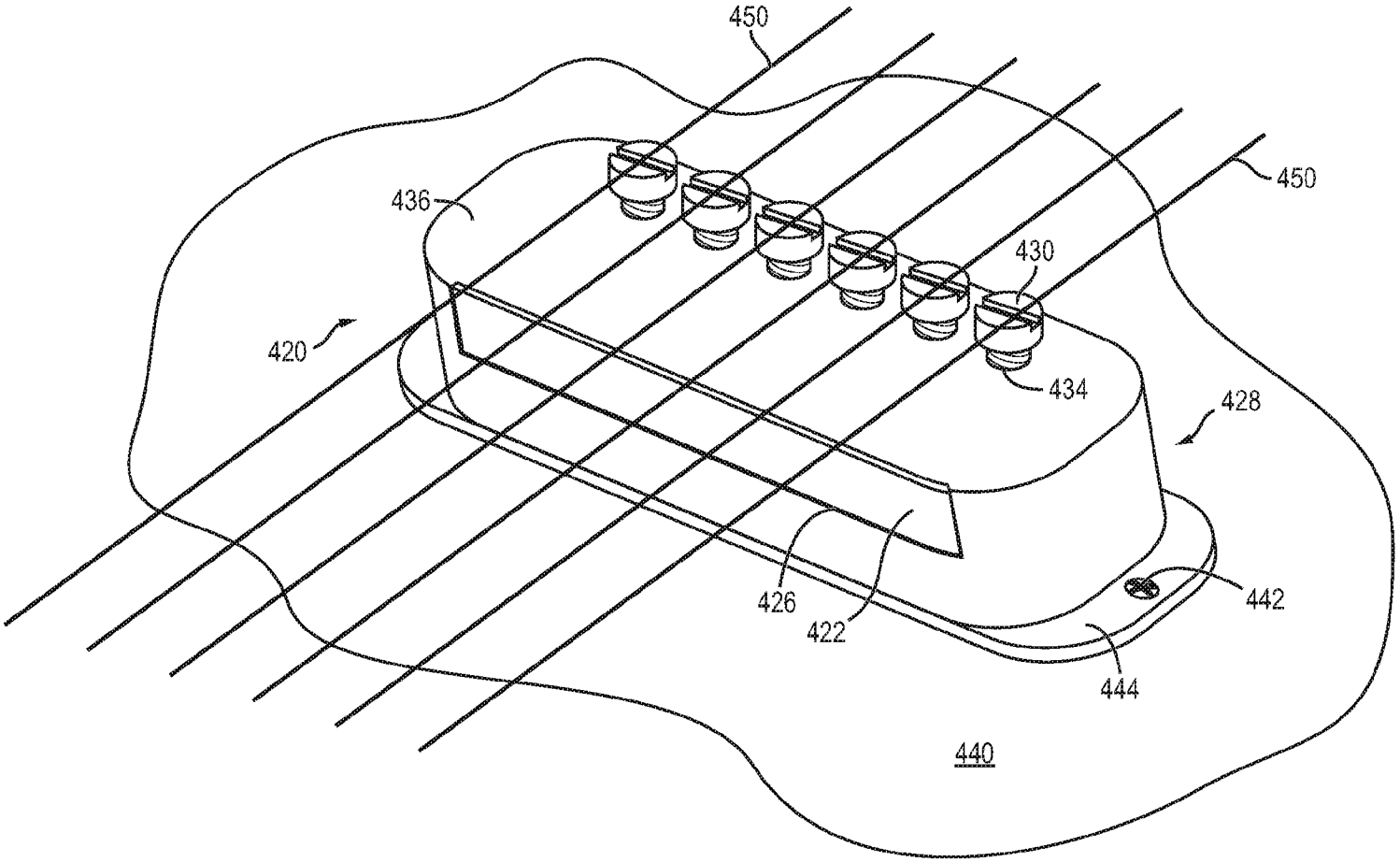
FIG. 7 illustrates a humbucking pickup with a combination of a blade and pole screws through pole shoes adjacent to a permanent magnet.

FIG. 7 illustrate humbucking pickup 420, having features of humbucking pickup assembly 154 from FIGS. 2*a*-2*i* and features of humbucking pickup 280 from FIGS. 5*a*-5*c*. Blade 422 is mounted to an exterior surface in a form-fitted slot of opening 426 in housing cover 428 over the north pole N surface of the permanent magnet, similar to FIG. 2*f*. Pole screws 430 are disposed through openings 434 in top surface 436 of housing cover 428, and further through a pole shoe magnetically coupled to the south pole S surface of the permanent magnet, similar to FIGS. 5*a*-5*c*. Accordingly, humbucking pickup 420 has blade 422 on one side of top surface 436 of housing cover 428 and pole screws 430 on the other side of the housing cover.

Humbucking pickup assembly 420 is mounted to guitar body 440 with screws 442 fastened through openings in mounting flange 444. Six guitar strings 450 are routed across top surface 436 of housing cover 428. Given the orientation of the permanent magnet in housing cover 428, the longitudinal axis of strings 450 run parallel with the north pole N surface and south pole S surface of the permanent magnet. Humbucking pickup assembly 420 responds to movement of strings 450 over blade 422 proximate to the north pole N surface of the permanent magnet, and further to the movement of strings 450 over pole screws 430 proximate to the south pole S surface of the permanent magnet.

While one or more embodiments of the present invention have been illustrated in detail, the skilled artisan will appreciate that modifications and adaptations to those embodiments may be made without departing from the scope of the present invention as set forth in the following claims.

What is claimed:

1. A humbucking pickup for a musical instrument, comprising:

a bobbin assembly including a first bobbin and a second bobbin;

a first coil wound around the first bobbin;

a second coil wound around the second bobbin;

a permanent magnet extending through an opening in the first bobbin and second bobbin with the first coil and second coil disposed around the permanent magnet; and a housing disposed over the bobbin assembly, wherein a north pole and south pole of the permanent magnet are oriented in parallel to a top surface of the housing.

2. The humbucking pickup of claim 1, wherein a plurality of strings of the musical instrument is routed over the top surface of the housing in parallel to the north pole and south pole of the permanent magnet.

3. The humbucking pickup of claim 1, further including:

a first blade disposed along a first side surface of the housing over the north pole of the permanent magnet; and a second blade disposed along a second side surface of the housing opposite the first side surface over the south pole of the permanent magnet.

4. The humbucking pickup of claim 1, further including:

a first pole shoe disposed over the north pole of the permanent magnet;

a first pole screw inserted into the first pole shoe;

a second pole shoe disposed over the south pole of the permanent magnet; and a second pole screw inserted into the second pole shoe.

5. The humbucking pickup of claim 1, further including a plurality of permanent magnets extending through the first coil and second coil of the bobbin assembly.

6. The humbucking pickup of claim 1, wherein the musical instrument includes an electric guitar, electric bass guitar, or string musical instrument incorporating the humbucking pickup.

7. A musical instrument including a humbucking pickup, the humbucking pickup comprising:

a bobbin assembly including a first coil wound around a first bobbin and a second coil wound around a second bobbin; and a permanent magnet extending through an opening in the first bobbin and second bobbin with the first coil and second coil disposed around the permanent magnet, wherein opposing magnetic poles of the permanent magnet are oriented in parallel to a surface of the musical instrument.

8. The musical instrument of claim 7, further including a housing disposed over the bobbin assembly.

9. The musical instrument of claim 8, further including:

a first blade disposed along a first side surface of the housing over a first pole of the permanent magnet; and a second blade disposed along a second side surface of the housing opposite the first side surface over a second pole of the permanent magnet.

10. The musical instrument of claim 8, wherein a plurality of strings of the musical instrument is routed over a top surface of the housing parallel to opposing poles of the permanent magnet.

11. The musical instrument of claim 7, further including:

a first pole shoe disposed over a first pole of the permanent magnet;

a first pole screw inserted into the first pole shoe;

a second pole shoe disposed over a second pole of the permanent magnet; and a second pole screw inserted into the second pole shoe.

12. The musical instrument of claim 7, further including a plurality of permanent magnets extending through the first coil and second coil of the bobbin assembly.

13. The musical instrument of claim 7, wherein the musical instrument includes an electric guitar, electric bass guitar, or string musical instrument incorporating the humbucking pickup.

14. A method of making a humbucking pickup, comprising:

providing a bobbin assembly including a first bobbin and a second bobbin;

winding a first coil around the first bobbin;

winding a second coil around the second bobbin;

disposing a permanent magnet through an opening in the first bobbin and second bobbin with the first coil and second coil disposed around the permanent magnet; and disposing a housing over the bobbin assembly, wherein opposing poles of the permanent magnet are oriented in parallel to a top surface of the housing.

15. The method of claim 14, further including routing a plurality of strings of the musical instrument over the top surface of the housing in parallel to opposing poles of the permanent magnet.

16. The method of claim 14, further including:

disposing a first blade along a first side surface of the housing over a first pole of the permanent magnet; and disposing a second blade along a second side surface of the housing opposite the first side surface over a second pole of the permanent magnet.

17. The method of claim 14, further including:

disposing a first pole shoe over a first pole of the permanent magnet;

inserting a first pole screw into the first pole shoe;

disposing a second pole shoe over a second pole of the permanent magnet; and inserting a second pole screw into the second pole shoe.

18. The method of claim 14, further including disposing a plurality of permanent magnets through the first coil and second coil of the bobbin assembly.

19. The method of claim 14, wherein the musical instrument includes an electric guitar, electric bass guitar, or string musical instrument incorporating the humbucking pickup.

20. A method of making a humbucking pickup for a musical instrument, comprising:

providing a bobbin assembly including a first coil wound around a first bobbin and a second coil wound around a second bobbin; and disposing a permanent magnet through the first coil and second coil of the bobbin assembly, wherein opposing magnetic poles of the permanent magnet are oriented in parallel to a surface of the musical instrument.

21. The method of claim 20, further including disposing a housing over the bobbin assembly.

22. The method of claim 21, further including:

disposing a first blade along a first side surface of the housing over a first pole of the permanent magnet; and disposing a second blade along a second side surface of the housing opposite the first side surface over a second pole of the permanent magnet.

23. The method of claim 21, further including routing a plurality of strings of the musical instrument over a top surface of the housing parallel to opposing poles of the permanent magnet.

24. The method of claim 20, further including:

disposing a first pole shoe over a first pole of the permanent magnet;

inserting a first pole screw into the first pole shoe;

disposing a second pole shoe over a second pole of the permanent magnet; and inserting a second pole screw into the second pole shoe.

25. The method of claim 20, further including disposing a plurality of permanent magnets through the first coil and second coil of the bobbin assembly.

* * * * *